US008709550B2

(12) United States Patent
Komori et al.

(10) Patent No.: US 8,709,550 B2
(45) Date of Patent: Apr. 29, 2014

(54) METHOD FOR PRODUCING COATED STEEL SHEET

(75) Inventors: Yuka Komori, Tokyo (JP); Masaki Kawano, Tokyo (JP); Kazumichi Sashi, Tokyo (JP); Akio Fujita, Tokyo (JP)

(73) Assignee: JFE Steel Corporation (JP)

( * ) Notice: Subject to any disclaimer, the term of this patent is extended or adjusted under 35 U.S.C. 154(b) by 1249 days.

(21) Appl. No.: 10/502,670

(22) PCT Filed: Jan. 24, 2003

(86) PCT No.: PCT/JP03/00625

§ 371 (c)(1),
(2), (4) Date: Jul. 27, 2004

(87) PCT Pub. No.: WO03/064063

PCT Pub. Date: Aug. 7, 2003

(65) Prior Publication Data

US 2005/0064107 A1 Mar. 24, 2005

(30) Foreign Application Priority Data

Jan. 28, 2002 (JP) ..... 2002-018267
Jan. 28, 2002 (JP) ..... 2002-018268
Mar. 14, 2002 (JP) ..... 2002-070167

(51) Int. Cl.
*B05D 5/06* (2006.01)

(52) U.S. Cl.
USPC ..... 427/543

(58) Field of Classification Search
USPC ..... 427/543
See application file for complete search history.

(56) References Cited

U.S. PATENT DOCUMENTS 3,891,471 A * 6/1975 Summers et al. ..... 148/248
4,045,393 A * 8/1977 Krevenas et al. ..... 524/272

(Continued)

FOREIGN PATENT DOCUMENTS

EP 0 923 088 A1 6/1999
JP 57-194210 A 11/1982

(Continued)

OTHER PUBLICATIONS

Tanoguchi et al., Japanese Patent 11-262710 (Machine Translation), Sep. 1999.*

*Primary Examiner* — Robert Vetere
(74) *Attorney, Agent, or Firm* — DLA Piper LLP (US)

(57) ABSTRACT

In a process for manufacturing a coated steel sheet such as a coated electromagnetic steel sheet using a water-based coating liquid containing an organic resin, to perform steps subsequent to an annealing step continuously at high speed without causing appearance defects such as coating unevenness; to provide an electromagnetic steel sheet having an insulating film thereon, in which properties of the film are satisfactory, superior weldability and punchability can be obtained without deteriorating the space factor, and the satisfactory film properties can be maintained even if the electromagnetic steel sheet having the insulating film thereon is temper-rolled. A coating liquid is applied onto an untreated steel sheet. The applied liquid is heated on the side close to the steel sheet in such a manner that the time elapsed until the steel sheet temperature is increased to 100° C. after the application is completed is 10 seconds or less, thereby drying the coating liquid. The steel sheet temperature is further increased to a predetermined temperature, thereby forming a coating film. When insulating films for electromagnetic steel sheets are formed, the coating liquid preferably further contains a water based inorganic component.

21 Claims, 14 Drawing Sheets

(56) References Cited

U.S. PATENT DOCUMENTS

| | | | | | |
|---|---|---|---|---|---|
| 4,137,349 | A | * | 1/1979 | Sakakibara et al. | 428/31 |
| 4,190,468 | A | * | 2/1980 | Kitayama et al. | 148/537 |
| 4,910,867 | A | * | 3/1990 | Weigert | 29/839 |
| 5,248,528 | A | * | 9/1993 | Robbins et al. | 427/522 |
| 5,259,892 | A | * | 11/1993 | Kubota et al. | 148/111 |
| 5,368,805 | A | * | 11/1994 | Motai | 264/272.15 |
| 5,456,953 | A | * | 10/1995 | Gosselin et al. | 427/522 |
| 5,859,107 | A | * | 1/1999 | Jones et al. | 524/406 |
| 6,447,620 | B1 | * | 9/2002 | Komiyama et al. | 148/251 |
| 6,638,633 | B1 | * | 10/2003 | Komori et al. | 428/457 |
| 2004/0028937 | A1 | * | 2/2004 | Egashira | 428/626 |

FOREIGN PATENT DOCUMENTS

| | | | | |
|---|---|---|---|---|
| JP | 59-085317 | | | 5/1984 |
| JP | 60-190572 | A | | 9/1985 |
| JP | 61-111177 | A | | 5/1986 |
| JP | 62-267493 | | | 11/1987 |
| JP | 03-056679 | | | 3/1991 |
| JP | 4-154972 | A | | 5/1992 |
| JP | 09-192602 | A | | 7/1997 |
| JP | 09-267073 | | | 10/1997 |
| JP | 10-46350 | A | | 2/1998 |
| JP | 10-046350 | A | | 2/1998 |
| JP | 11-262710 | A | * | 9/1999 |
| JP | 2000-345360 | A | | 12/2000 |
| JP | 2001-107261 | | | 4/2001 |
| JP | 2001-155947 | | | 6/2001 |
| JP | 2003-213444 | | | 7/2003 |

* cited by examiner

METHOD FOR PRODUCING COATED STEEL SHEET

TECHNICAL FIELD

This disclosure relates to a coated steel sheet and particularly relates to a process for manufacturing a coated steel sheet having superior film properties such as satisfactory appearance. In the process, water-based paint containing a resin is applied onto a steel sheet and the resulting steel sheet is dried and then baked, whereby a coated steel sheet is efficiently manufactured.

Furthermore, the disclosure relates to a process for manufacturing a nonoriented electromagnetic steel sheet having an insulating film with superior film properties based on the above manufacturing process.

BACKGROUND

Cold rolled steel sheets and nonoriented electromagnetic steel sheets and the like rolled so as to have a final thickness are usually subjected to final annealing at a high temperature in a reductive atmosphere and then coated according to needs, thereby obtaining final products. There are many types of paints, and a water-based paint containing an organic resin is usually used. Furthermore, there are many types of coating processes, and a roll coating process is widely used because this process is satisfactory in productivity and fit for strictly controlling the thickness of thin films. In a process using such water-based paint, a coating liquid is applied onto a steel sheet and the resulting steel sheet is heated, thereby drying the applied liquid and then baking the obtained coating. In known processes, a heating apparatus such as an air(gus)-heating furnace and electric furnace are used because such furnaces are relatively low in equipment cost and operating cost.

Recently, in view of productivity, demands have been made on a high-speed coating process. For example, Japanese Unexamined Patent Application Publication No. 11-262710 discloses a coating apparatus that can be operated at a line speed of 150 m/min. In known heating methods, however, there is a problem in that rapid heating operations are difficult and seriously uneven coatings are formed.

In order to cope with such a problem, for example, Japanese Examined Patent Application Publication No. 53-4528 discloses a process for manufacturing a coated steel sheet. The process includes a step of applying a coating liquid onto a steel sheet, a step of heating the resulting steel sheet for 1-5 seconds by an infrared radiation method, and a step of baking the resulting steel sheet at high speed by a high-frequency induction heating method, wherein these steps are performed in that order.

On the other hand, Japanese Unexamined Patent Application Publication No. 3-56679 discloses another process for manufacturing a coated steel sheet, because moisture cannot be sufficiently removed from the coating liquid using radiation heat, whereby the following defects are caused: appearance defects such as orange peels and poor film properties such as poor adhesion. This process at least includes a drying step (the heating temperature is about 130 to 150° C.) in which the heating rate is 20° C/s or less and a high-frequency induction heating method is used. Furthermore, Japanese Unexamined Patent Application Publication No. 62-133083 discloses other processes including a drying step using a high-frequency induction heating method and a subsequent heating step using an air(gas)-heating furnace.

However, even if the above processes are used, fine uneven portions are formed in coatings and therefore it is difficult to avoid the formation of uneven coatings on an industrial scale. Further, a coating appearance defect called flash rust arises in some cases depending on the composition of a coating liquid, and such a defect cannot be sufficiently eliminated by the above processes.

Since there are the above-mentioned problems, the operating speed of current drying and baking lines is usually about 60-80 m/min and, even in contemporary lines, is 150 m/min at the most.

In recent years, in coating steps, coating lines are directly connected to final annealing furnaces. Therefore, in order to avoid an increase in length of lines for manufacturing steel sheets, there are needs for compact coating lines. For such a purpose, vertical coating lines (steel sheets are subjected to coating, drying, baking, and the like while they are moved in substantially a vertical direction) are preferable as compared with known horizontal coating lines (steel sheets are subjected to coating, drying, baking, and the like while they are moved in substantially a horizontal direction), because the horizontal coating lines occupy a large area. However, during this research, we found that the above-mentioned coating unevenness is serious when such vertical coating lines are used.

Current coating processes have another following problem: when a water-based coating liquid containing a resin is continuously applied onto steel sheets for a long time using a roll coater coating apparatus directly connected to a final annealing furnace, the heat of the steel sheets causes the resin to be adhered to the roll coater and therefrom coating appearance defects arise.

In order to solve such a problem, Japanese Unexamined Patent Application Publication No. 4-154972 discloses a process for forming a coating on an electromagnetic steel sheet. In this process, when a treating liquid containing a chromium compound and an organic resin is applied onto such an electromagnetic steel sheet processed in a final annealing step, the treating liquid and electromagnetic steel sheet are maintained at 25° C. or less.

According to the process, the resin can be prevented from being adhered to the roll coater when the treating liquid and steel sheet are maintained at 25° C. or less. However, this advantage is limited. Even if the process is employed, in a long time, the resin is adhered to the roll coater depending on the type of the resin.

Coated steel sheets include nonoriented electromagnetic steel sheets coated with an insulating film formed by a painting method. When such nonoriented electromagnetic steel sheets are manufactured by the above manufacturing processes, the problems below arise.

The coated nonoriented electromagnetic steel sheets are used for iron cores for motors and transformers in many cases, and the iron cores are prepared according to the following procedure: each steel sheet is punched into pieces having a predetermined shape by a punching process and the obtained pieces are stacked. Therefore, the steel sheets must have satisfactory punchability and weldability properties (for welding end faces). In order to enhance the punchability, it is effective that the insulating film contains a resin, that is, such a resin is a component (coating component) of the insulating film. However, the contained resin causes blowholes during a welding operation. Therefore, it is necessary to obtain both satisfactory punchability and weldability.

In order to achieve the compatibility between the punchability and weldability of the nonoriented electromagnetic steel sheets, the processes below have been proposed.

(1) A process in which roughness is increased on a steel sheet or an insulating film (for example, Japanese Unexamined Patent Application Publication No. 60-190572)

(2) A process in which an insulating film contains Al (for example, Japanese Unexamined Patent Application Publication No. 9-291368)

(3) A process in which a resin is improved in heat resistance (for example, Japanese Unexamined Patent Application Publication No. 6-235070)

(4) A process in which a double layer coating is used (for example, Japanese Examined Patent Application Publication No. 49-6743)

(5) A process in which a liquid containing a chromate-based inorganic coating component and a resin component is applied onto a steel sheet and a special resin is concentrated at the surface of a coating (for example, Japanese Examined Patent Application Publication No. 4-43715)

In process (1), although satisfactory punchability and weldability can be obtained, magnetic properties of an obtained core material are inferior because stacked steel sheet pieces have a small space factor. In processes (2) and (3), there is plenty of room for further improvement because the compatibility between the following properties cannot be achieved: superior TIG weldability equivalent to those of an inorganic coating and superior punchability equivalent to those of an organic coating. In process (4), there is a problem in that manufacturing cost and the like are high because a procedure of applying a coating liquid onto a steel sheet and then baking the resulting steel sheet is repeated twice, that is, two coating operations and two baking operations are performed. In process (5), there is also a problem in that manufacturing cost is high because available resins and inorganic components are limited.

Accordingly, in the known coating processes, the compatibility between the satisfactory punchability and weldability cannot be achieved without causing other serious problems.

A species of nonoriented electromagnetic steel sheet delivered in the semi-processed state has the problems below.

A process for manufacturing an electromagnetic steel sheet includes the following subsequent steps:

(a) a step of forming a steel ingot, such as a slab, having adjusted composition, (b) a step of hot-rolling the slab and then annealing the hot-rolled steel sheet according to needs, (c) a step of subjecting the steel sheet to cold-rolling (or warm-rolling) and then subjecting the resulting steel sheet to annealing, once or several times according to needs, and (d) a step of providing an insulating film on the resulting steel sheet according to needs (insulating coating treatment).

A process for manufacturing a nonoriented electromagnetic steel sheet delivered in the semi-processed state further includes a step of temper-rolling the resulting steel sheet to apply a strain to the steel sheet in addition to the above steps, wherein the temper-rolling step follows step (c). Step (d) of providing the insulating film is then performed according to needs.

The temper-rolling step may follow step (d) for performing the insulating coating treatment in order to avoid increasing the complexity of handling when an annealing apparatus (usually a final annealing apparatus) used in the final part of step (c) is directly connected to an apparatus for the insulating coating treatment and therefore a temper rolling mill cannot be installed therebetween. In this case, there is a problem in that the insulating film is partly damaged during the application of strain and thereby the film properties are deteriorated.

SUMMARY

We provide a process for manufacturing a coated steel sheet. In this process, water-based coating liquid containing an organic resin is applied onto a steel sheet, and the resulting steel sheet is dried and then baked. The process includes the following techniques:

(1) a coated steel sheet-manufacturing technique in which a high-speed baking operation can be performed without coating unevenness and flash rust and which can be used for vertical coating lines in which coating unevenness is apt to occur, (2) a coated steel sheet-manufacturing technique in which resin is not adhered to a roll coater even if a coating operation is continuously performed at high speed for a long time using the roll coater, (3) a technique manufacturing a nonoriented electromagnetic steel sheet having an insulating film in which the compatibility between high level of punchability and weldability properties can be achieved, and (4) a nonoriented electromagnetic steel sheet-manufacturing technique in which excellent film properties can be achieved even if a steel sheet covered with an insulating film is temper-rolled.

In research for establishing technique (1), we found that it is insufficient to investigate only drying means and the drying time in order to eliminate factors of causing coating unevenness.

According to our findings, since a steel sheet is treated while the steel sheet is conveyed on a transfer line, the steel sheet applied with a coating liquid continuously suffers from vibration, impact, and paint drips, though weak, on a way from a coating step to a drying step and these factors cause the coating unevenness. According to the our findings, in a vertical coating line in which gravity is applied to a coating liquid in the longitudinal direction of the steel sheet, the influence of the vibration and so on is serious and therefore the coating unevenness is apt to occur in such a vertical coating line.

Thus, in order to prevent the coating unevenness from occurring, it is a key to minimizing the time elapsed between the application of the coating liquid and the substantial completion of drying (the temperature of the steel sheet reaches 100° C.).

Furthermore, we found that flash rust is seriously formed when a final annealing line and coating line directly connected to each other are used and found that Fe is dissolved in the coating liquid when the coating liquid is applied to the steel sheet of which surface is activated by a final annealing operation and the dissolution of Fe is a main factor of causing the formation of such flash rust.

Based on the above findings, we found that the following operations are effective in preventing the flash rust from being formed: the time elapsed between the application of the coating liquid and the completion of drying is controlled in the same manner as that of the operation of preventing the coating unevenness from occurring, and the annealed steel sheet is preferably washed with water such that the surface activity of the steel sheet is lowered and the resulting steel sheet is then subjected to the coating step.

Furthermore, in research for establishing technique (2), we found that it is preferable to control the steel sheet temperature depending on the glass transition point of a thermoplastic resin when contained in the coating liquid because the temperature control is effective in preventing the resin from being adhered to the roll coater during the coating operation continuously performed at high speed for a long time.

Furthermore, in research for establishing technique (3), we found that a resin is thickened at the surface of a coating and thereby the punchability is greatly enhanced when the upper face of the coating is not baked using an air(gas)-heating furnace or electric furnace used in many known processes but the lower face of the coating is heated by a method such as an induction heating method, that is, the coating is heated on the side close to the steel sheet. We further found that low boiling point components that cause blowholes can be efficiently removed from the coating by heating the coating on the side close to the steel sheet, thereby enhancing the weldability.

Furthermore, we found that it is effective in establishing technique (4) to thickened the resin at the surface of the insulating coating by heating the coating on the side close to the steel sheet and also found that cracks that causes a deterioration in film properties are not formed on the coating surface even if the coated steel sheet treated as described above is subjected to temper rolling at a reduction ratio of about 8%.

A first aspect of the disclosure provides a process for manufacturing a coated steel sheet. The process includes a washing step of washing an annealed steel sheet with water, which is preferable, a coating step of applying a water-based coating liquid containing a resin onto the resulting steel sheet, a drying step of drying the applied liquid to form a coating layer in such a manner that the applied liquid is heated on the side close to the steel sheet and the time elapsed until the temperature of the steel sheet is increased to 100° C. after the application is completed is 10seconds or less, and a baking step of heating the dry coating layer to a predetermined temperature to bake the coating layer to form a coating film, these steps being performed in that order.

In the washing step using water, pickling may be performed.

The process can be applied to a horizontal coating line that has been used in many cases and also applied to a vertical coating line. In the latter case, when the coating step, drying step, and baking step are performed using a coating apparatus and heating apparatus that are vertically arranged, ensuring the appearance is satisfactory in particular.

A face of the steel sheet may be coated in the coating step and both faces may be coated in the coating step. When both faces are coated, a coating apparatus for simultaneously coating both faces of the steel sheet is preferably used in the coating step in order to perform the coating step and drying step in a short time. In particular, a vertical coating apparatus is preferable.

A second aspect of the disclosure is as follows: in the process for manufacturing a coated steel sheet having satisfactory appearance according to the first aspect, the water-based coating liquid containing the resin is applied onto the steel sheet using a roll coater and the temperature of the uncoated steel sheet is 60° C. or less and lower than or equal to a temperature 20° C. higher than the glass transition point (Tg) of the resin contained in the water-based coating liquid.

A third aspect of the disclosure provides a process for manufacturing an electromagnetic steel sheet having satisfactory weldability and punchability and having an insulating film thereon. In the process, a water-based coating liquid for forming an insulating film containing a resin and inorganic component onto an electromagnetic steel sheet, the applied liquid is dried so as to form a coating layer in such a manner that the applied liquid is heated on the side close to the steel sheet and the time elapsed until the temperature of the steel sheet is increased to 100° C. after the application is completed is 10 seconds or less, and the dry coating layer is then heated to a predetermined temperature, whereby the coating layer is baked.

For the resin contained in the liquid, the percentage of any one of the following resins in the total resin amount is 50 mass % or more: an emulsion resin, dispersion resin, suspension resin, and powder resin having a particle size of 30 nm or more.

A fourth aspect of the disclosure is as follows: in the process for manufacturing an electromagnetic steel sheet according to the third aspect, a material (usually a steel ingot such as a slab) for manufacturing the electromagnetic steel sheet is subjected to rolling and annealing at an ultimate sheet temperature of 600 to 1000° C., once or a plurality of times, such that a steel sheet having a thickness of 0.1 to 0.9 mm is formed, the steel sheet is cooled to 60° C. or less, the water-based coating liquid containing the resin and inorganic component onto the obtained electromagnetic steel sheet, the resulting steel sheet is dried and then baked, and the resulting steel sheet is then temper-rolled at a reduction ratio of 10% or less. The nonoriented electromagnetic steel sheet is delivered in the semi-processed state and has excellent magnetic properties and film properties.

The time elapsed until the steel sheet temperature is increased to 100° C. after the application is completed is preferably 8 seconds or less and more preferably 6 seconds or less.

In order to heat the applied liquid and coating layer on the side close to the steel sheet, an induction heating method is preferably used and a high-frequency induction heating method is particularly preferable. The method is preferably used in the drying step. In order to achieve high line speed and film properties, the method is preferably used in both drying step and baking step in particular.

DETAILED DESCRIPTION

Figure 1:
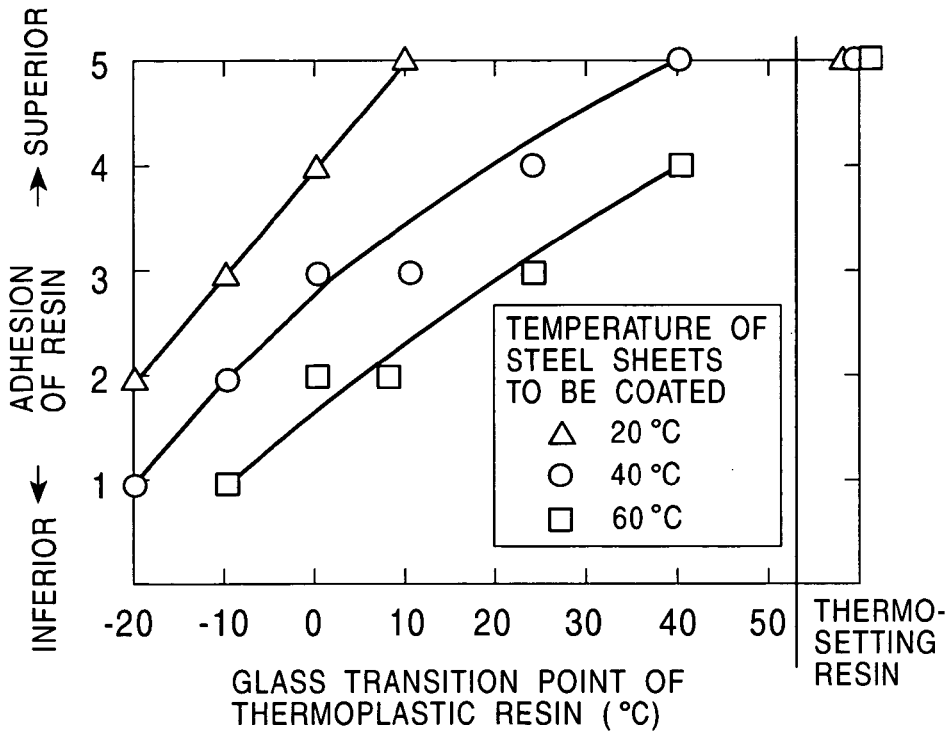
FIG. 1 is a graph showing the relationship between the occurrence of a phenomenon that a resin is adhered to a roll coater and the glass transition temperature of the resin categorised by the temperature of the steel sheet.

Steel sheets subjected to a coating step will now be described.

The process is applied to annealed steel sheets. The composition and quality of the steel sheets to be treated are not particular limited, and the process is preferably applied to various cold-rolled sheet steels such as electromagnetic steel sheets.

There is no limitation for nonoriented electromagnetic steel sheets except that a main component thereof is iron. The composition of the steel sheets is preferably adjusted depending on desired properties of cores and the like for which the steel sheets are used.

Since an increase in resistivity is effective in enhancing, for example, the iron loss, the steel sheets preferably contain the following components, which increase the resistivity, according to needs: Si, Al, Mn, Cr, P, Ni, Cu, and so on. The content of these components may be determined depending on desired magnetic properties. In general, the Si content is about 5 mass % or less, the Al content is about 3 mass % or less, the Mn content is about 1.0 mass % or less, the Cr content is about 5 mass % or less, the P content is about 0.5 mass % or less, the Ni content is about 5 mass % or less, and the Cu content is about 5 mass % or less (the expression "several mass % or less" herein covers substantially 0 mass %).

Segregation elements such as Sb and Sn are not excluded and 0.5 mass % or less of such elements may be contained. The elements C and S are disadvantageous for the weldability as well as the magnetic properties among minor components (C, S, N, O, and the like) and therefore the content of such elements is preferably low. The C content is preferably about 0.02 mass % or less and the S content is preferably about 0.01 mass % or less. The content of other unavoidable impurities such as N, O, Ti, Nb, V, and Zr is also preferably as low as possible in view of the magnetic properties.

The above components are contained in steel ingots such as slabs, which are starting materials. In final products, the C content is reduced to about 0.005 mass % or less in general.

Every steel sheet used for the purpose of utilizing the magnetic properties shall be herein referred to as a electromagnetic steel sheet.

There is no limitation on processes for manufacturing cold-rolled steel sheets or nonoriented electromagnetic steel sheets to be treated. Known various processes may be employed.

Steps (steps performed before a coating step) of manufacturing such nonoriented electromagnetic steel sheets include, for example, a rolling step and annealing step that are performed once or several times such that a steel sheet having a predetermined thickness can be obtained from the slab of above composition. The term rolling herein means hot rolling or cold rolling (including warm rolling). Furthermore, the term annealing herein means the annealing of hot-rolled steel sheets, intermediate annealing, or finish annealing.

A typical process includes the following sequence:

a sequence of a hot rolling step, a step of annealing a hot-rolled steel sheet, a cold rolling step, and a finish annealing step (a so-called single cold-rolling method); or a sequence of a hot rolling step, a step of annealing a hot-rolled steel sheet, a cold rolling step, an intermediate annealing step, a cold rolling step, and a finish annealing step (a so-called double cold-rolling method).

In the above process, the step of annealing a hot-rolled steel sheet is omitted in some cases. A warm rolling step is typically employed instead of the cold rolling step. The hot rolling process may be replaced with the warm rolling step or omitted if possible. An annealing step performed after the cold rolling step is not limited to the finish annealing step and another annealing step for other purposes is inserted in some cases.

An annealing method used in the above steps is not particular limited, and a batch annealing method or continuous annealing method is used in many cases. In particular, such a continuous annealing method is preferably used in the final annealing step (finish annealing step in general) and a subsequent step of continuously forming a coating is preferably employed in view of production efficiency and cost.

In each annealing step, the annealing temperature, that is, the ultimate temperature of the steel sheets is preferably controlled within a range of about 600 to about 1100° C. That is, in order to promote the growth of grains sufficiently in the annealing step, the ultimate temperature is preferably about 600° C. or more. On the other hand, since an increase in iron loss is saturated if heating treatment is performed at an excessively high temperature, the ultimate temperature is preferably 1100° C. or less. When nonoriented electromagnetic steel sheets delivered in the semi-processed state are manufactured, the upper limit of the annealing temperature is preferably 1000° C.

In common with usual processes for manufacturing cold-rolled steel sheets, the single cold rolling process is employed and the hot-rolled steel sheet-annealing step is omitted in many cases. There is no limitation on the annealing atmosphere and temperature. Our process can be applied to the steel sheets annealed at a temperature higher than the recrystallization temperature, for example, in a nitrogen-hydrogen atmosphere or in an inert atmosphere containing nitrogen, argon, or the like.

There is no limitation on the rolling speed of the steel sheets. When the rolling speed is high, that is, 150 m/min or more, a shear stress is applied to a resin with a roll coater and therefore the resin is apt to be adhered to the roll coater. In such an operation, our process is particularly advantageous.

When the electromagnetic steel sheets are manufactured without performing temper rolling, the steel sheets are rendered to have a final thickness through the above steps. The final thickness of the steel sheets is not particular limited, and the steel sheets may have various thicknesses. Thickness is preferably about 0.8 mm or less in view of the magnetic properties.

For the electromagnetic steel sheets subjected to temper rolling, for example, the nonoriented electromagnetic steel sheets delivered in the semi-processed state, the term "predetermined thickness" described above does not mean the final thickness. The predetermined thickness is preferably controlled within a range of about 0.1 to about 0.9 mm or less in view of the final thickness considering magnetic properties and in view of a decrease in thickness due to temper rolling.

For other ordinary cold-rolled steel sheets, there is no limitation on the thickness. When the thickness is large, there is a fear that the heating rate cannot be sufficiently increased although the heating rate must be high in order to dry the steel sheets, covered with a water-based coating liquid, rapidly. Therefore, the thickness is preferably about 0.9 mm or less.

There is no limitation on the surface roughness of the uncoated steel sheets. When the space factor is important, the surface roughness Ra (specified in JIS B 0601) is preferably about 0.5 μm or less.

The annealed steel sheets are preferably washed with water before a coating liquid is applied thereto. As described below, the water washing prevents flash rust, due to Fe dissolved in the coating liquid, from being formed, thereby allowing the steel sheets to have good appearance.

When another coating liquid containing a sufficient amount of a component (for example, a chromium compound such as chromic acid or the like) having a passivation function is used, the flash rust due to Fe dissolved in the coating liquid can be prevented, due to the passivation function, from being formed. Even in this case, in order to avoid surface defects (craters and the like) due to a difference in surface activity, the water washing is preferably performed.

A water washing method is not particular limited and includes arbitrary methods such as a dipping method, a spraying method, and a brash washing method.

The water washing may be performed together with pickling. In this case, rinsing is preferably performed using water.

A water-based coating liquid containing resin is then applied onto the steel sheets, which have been annealed and then preferably washed with water.

The resin may be selected depending on properties of the coated steel sheets. The resin includes an acrylic resin, an epoxy resin, a urethane resin, a phenol resin, a styrene resin, an amide resin, an imide resin, a urea resin, a vinyl acetate resin, an alkyd resin, a polyolefin resin, a polyester resin, a fluorocarbon resin, and a silicone resin. These resins may be used alone or in combination or used together as a copolymer.

The resin is soluble or dispersible (including emulsion)in water, and therefore it is referred to as a so-called water based resin. The dissolution or dispersion state of the resin is not particularly limited, and the resin may be used in the form of solution, emulsion, dispersion, suspension, powder, or the like. The emulsion and so on are defined based on general classification used in a technical field in which such a water based resin is used.

When the coating is used for forming an insulating film for the electromagnetic steel sheets, an improvement in punchability is slight if the liquid only contains a water-soluble resin that is completely dissolved in water and therefore does not form particles in the liquid. Thus, the percentage of a particle-forming resin (a so-called dispersible resin such as an emulsion resin, a dispersion resin, a suspension resin, and a powder resin) in the total resin amount is preferably about 50 mass % or more.

Since an improvement in punchability is remarkable when the size of the resin particles is large to some extent, the resin particles preferably have a size of about 30 nm or more. It is advantageous that the particle size is large in view of weldability, and therefore the upper limit of the particle size is not particular limited; however, the size is preferably about 1 μm or less when the space factor is important. The particle size of the emulsion resin, dispersion resin, suspension resin, and the like is defined as an average particle size obtained by light scattering measurement.

The water-based coating liquid containing the above resin may further contain an inorganic component (component that is soluble or dispersible in water). In particular, the inorganic component is essential when the liquid is used for forming insulating films on the electromagnetic steel sheets, which are subjected to stress relief annealing. If the steel sheets are not subjected to the stress relief annealing but are subjected to welding, the liquid preferably contains the inorganic component.

The inorganic component contains a principal sub-component (which is used for forming a film and of which the content in the inorganic component contained in a coating component is 50 mass % or more). The principal sub-component includes chromate compounds (chromates, dichromates, and the like), phosphate compounds (phosphates and the like), and inorganic colloidal compounds. A mixture of these compounds may be used according to needs. These inorganic compounds are selected as long as they are compatible with the resin. The chromate compounds include, for example, chromic anhydride and chromates containing a metal ion having a valency of one to three, the phosphate compounds include, for example, phosphates containing a metal ion having a valency of one to three, and the inorganic colloidal compounds include silica, alumina, titania, antimony pentoxide, and tin oxide, and these compounds may be used alone or in combination. The inorganic component is not limited to the compounds described above. The inorganic colloidal compounds are advantageous in that they are ecologically friendly and fit for low-temperature baking.

When the water-based coating liquid contains the inorganic component, the ratio of inorganic substances to organic substances in the water-based coating liquid preferably ranges from 5:95 to 95:5. The ratio is not particular limited and may be determined depending on desired properties. For example, the percentage of the organic substances is preferably 10% or more when the punchability are important, and the percentage of the inorganic substances is preferably 20% or more when the stress relief annealing is necessary.

The concentration of the liquid used in a coating step may be controlled within an appropriate range lower than the dissolution limit or dispersion limit so as to achieve a target area weight. The total solute and dispersoid content is preferably 0.1 mass % or more in view of productivity.

In order to ensure compatibility between resin components each other or compatibility between the resin and inorganic component, the water-based coating liquid may further contain a stabilizing agent, surfactant, and/or the like in addition to the above components according to needs. Furthermore, in order to enhance various properties, the water-based coating liquid may contain various additives. The water-based coating liquid may further contain an agent for promoting the film formation. The water-based coating liquid may further contain an organic solvent.

The stabilizing agent includes colloid stabilizers, pH regulators (acidic agents or alkaline agents), and the like, and various types of stabilizing agents may be used according to the components in the coating. The surfactant includes nonionic surfactants that are effective in preventing the resin particles from being aggregated and may include other agents for synthesis. The additives for enhancing the various properties include boric acid for enhancing heat resistance and rust preventives for enhancing corrosion resistance. The agent for promoting the film formation includes oxidizing agents, reducing agents (for example, alcohols, glycols, and carboxylic acids), and the like. The agent is not limited to the above.

The total additive amount is preferably about 30 mass % or less with respect to the total solute and dispersoid amount in the water-based coating liquid.

The water-based coating liquid containing the resin and so on is applied onto each washed steel sheet with, for example, a roll coater so as to form a coating layer having a predetermined thickness. A method for applying the water -based coating liquid is not particular limited as long as the liquid can be applied onto the steel sheet and includes various methods such as a roll coater method, bar coater method, air-knife method, and spray coater method. The liquid of this disclosure is usually applied onto both faces of the steel sheet and may be only applied onto one face thereof.

The roll coater method is widely used as described above because of high productivity and facility in controlling the layer thickness. In particular, a roll coater for simultaneously applying the liquid onto both faces is preferably used. In this case, in order to ensure the contact angle, coater portions each in contact with the front face or back face of the steel sheet may be slightly displaced. When both faces are separately coated using another roll coater for applying the liquid onto one face, one face onto which the liquid has been applied cannot be subjected to a drying step until the liquid is applied onto the other face. Therefore, there is a fear that uneven coatings and flash rust, which are described below, are formed. The roll coater for simultaneously applying the liquid onto both faces may be of a horizontal type or vertical type and is preferably of a vertical type in view of the space for installation.

When the water-based coating liquid is applied onto the annealed steel sheet having a high temperature, the water based resin is aggregated in a pan of the coater and appearance defects such as pinholes, craters, and spots are caused by the heat of the steel sheet depending on the type of the liquid. Thus, it is preferable that the steel sheet is sufficiently cooled before the application according to the needs of the liquid and the liquid is then applied onto the resulting steel sheet. As a measure, the liquid is preferably applied onto the steel sheet after the steel sheet is cooled to about 60° C. or less. In particular, when nonoriented electromagnetic steel sheets that are temper-rolled after the application and delivered in the semi-processed state are manufactured, the application temperature is preferably about 60° C. or less in order to ensure the coating quality.

When the water-based coating liquid containing a thermoplastic resin is applied onto the steel sheet by the roll coater method, the temperature of the uncoated steel sheet (steel sheet ready to be coated) is preferably lower than or equal to a temperature 20° C. higher than the glass transition point Tg of the resin contained in the liquid, in addition to the above conditions. This temperature condition is particularly effective in preventing the resin from being adhered to the roll coater when the coating operation is continued for a long time.

Experimental results that support the above finding will now be described.

FIG. 1 is a graph showing the relationship between the occurrence of a phenomenon that each resin is adhered to a roll coater and the glass transition temperature of the resin. In the figure, the temperature of steel sheets is used as a parameter. The relationship was obtained according to the procedure below. Coating components and additives (the composition of a combination of solutes and dispersoids is 30 mass % of the resin, 55 mass % of magnesium dichromate, and 15 mass % of ethylene glycol) were dissolved in water, thereby obtaining each water-based coating liquid having a total coating component and additive content of 5 mass %. The water-based coating liquid was applied onto 100 t (t herein represents ton) of the steel sheets having a thickness of 0.5 mm and a width of 1300 mm. The resins used were acrylic and styren copolymers having different glass transition points obtained by varying the monomer composition thereof. These resins were emulsified, and dispersed resin particles had an average size of 80-200 nm. The temperature of each steel sheet was measured at the input portion of a coating apparatus. Standards for evaluating the resin adhesion shown in FIG. 1 are as shown in Table 1.

The roll coater was of a vertical type of simultaneously applying liquid onto both faces and was the same as that disclosed in Japanese Unexamined Patent Application Publication No. 11-262710. The coating speed was 300 m/min and the peripheral speed of applicator rollers was 300 m/min.

TABLE 1

| Rating | Adhesion of Resin |
|---|---|
| 1 | Adhesion of a resin is serious. |
| 2 | Adhesion of a resin is observed. |
| 3 | Adhesion of a resin is slight. |
| 4 | Adhesion of a resin is hardly observed. |
| 5 | No adhesion of a resin is observed. |

FIG. 1 shows that the above phenomenon that the resins are adhered to the roll coater when the application operation is continued for a long time has a correlation with the glass transition point (Tg) of the thermoplastic resins and the steel sheet temperature. That is, the resins are apt to be adhered to the roll coater when the steel sheet temperature exceeds a temperature 20° C. higher than the glass transition point (Tg) of the thermoplastic resins.

Figure 2:
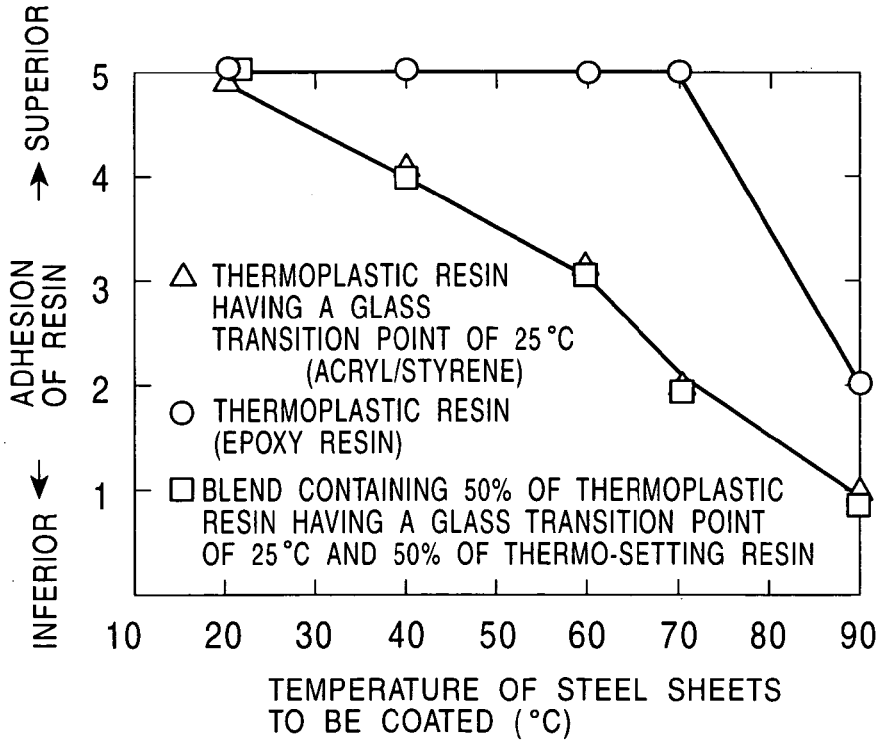
FIG. 2 is a graph showing the relationship between the occurrence of a phenomenon that a resin used is adhered to a roll coater and the temperature of a steel sheet.

FIG. 2 is a graph showing the relationship between the occurrence of a phenomenon that each resin is adhered to the roll coater and temperature of the steel sheet. The relationship was obtained according to the procedure below. Coating components and additives (the composition of a combination of solutes and dispersoids is 30 mass % of each resin, 55 mass % of magnesium dichromate, and 15 mass % of ethylene glycol) were dissolved in water, thereby obtaining each water-based coating liquid having a total coating component and additive content of 5 mass %. The water-based coating liquid was applied onto 100 t of steel sheets having a thickness of 0.5 mm and a width of 1300 mm. The following resins were used: (1) an acrylic and styrene copolymer having a glass transition point of 25° C., (2) a blended resin consisting of 50 mass % of the acrylic and styrene copolymer having a glass transition point of 25° C. and 50 mass % of an epoxy resin, and (3) the epoxy resin (thermosetting resin). These resins were emulsified, and dispersed resin particles had an average size of 80-500 nm. Operating conditions in a coating step are the same as those of the experiment for obtaining the relationship shown in FIG. 1. Standards for evaluating the resin adhesion are also as shown in Table 1.

FIG. 2 shows that the degree of the phenomenon that each resin is adhered to the roll coater is in proportion to the steel sheet temperature and shows that the resin is not aggregated and therefore is not adhered to the roll coater when the steel sheet temperature is lower than or equal to a temperature 20° C. higher than the glass transition point (Tg) of the thermoplastic resin. Furthermore, FIG. 2 shows that the thermosetting resin is not adhered to the roll coater when the steel sheet temperature is 60° C. or lower.

The relationships shown in FIGS. 1 and 2 are generally observed without depending on the type, composition, and content of thermoplastic resins and the speed of lines for conveying steel sheets. Thus, the following conditions are preferable: the steel sheet temperature is 60° C. or less, and when a water-based coating liquid contains a thermoplastic resin, the steel sheet temperature is lower than or equal to a temperature 20° C. higher than the glass transition point Tg of the thermoplastic resin.

The steel sheets onto which the respective water-based coating liquids have been applied under the above conditions are subjected to a step of drying the applied liquids and then baking the steel sheets. In the drying and baking step, in order to prevent uneven coatings and flash rust from being formed, it is a key to controlling the time, elapsed until the steel sheet temperature is increased to 100° C. after the application of the water-based coating liquids is completed, 10 seconds or less. The time is preferably 8 seconds or less and more preferably 6 seconds or less.

Experimental results that support the above finding will now be described.

Steel slabs containing the following components were manufactured: 0.002 mass % of C, 0.3 mass % of Si, 0.2 mass % of Mn, and 0.001 mass % of Al, the remainders being iron and unavoidable impurities. The steel slabs were subjected to hot rolling and cold rolling, and the obtained steel sheets were annealed at 800° C. in an atmosphere in which the ratio of $H_2$ to $N_2$ is 30:70 (the ratio is expressed on a volume basis, and ratios in the atmospheres below are expressed in the same manner), thereby obtaining the annealed steel sheets having a thickness of 0.5 mm. Water-based coating liquids were each applied onto the corresponding annealed steel sheets without washing the annealed steel sheets with water. The water-based coating liquids contained water and solutes and dispersoids dissolved or dispersed in the water and had a total solute and dispersoid content of 5 mass %. Each combination of the solutes and dispersoids had the ratio of an inorganic component to an organic component to ethylene glycol as shown in Tables 2-1 and 2-2. An acrylic and styren copolymer was used as a resin component. The coated steel sheets were dried and then baked under the conditions shown in Tables 2-1 and 2-2. The coating thickness (the area weight per face in a dry state) was 1.0 g/m$^2$.

The acrylic and styrene copolymer was emulsified and had a glass transition point of 30° C., and dispersed resin particles had an average size of 150 nm. The temperature of the steel sheets placed at the input portion of a coating unit was controlled to 30° C.

When the coating unit was placed in a vertical line, the coating unit was of a vertical type of simultaneously applying liquid onto both faces and was the same as that disclosed in Japanese Unexamined Patent Application Publication No. 11-262710. When the coating unit was placed in a horizontal line, the coating unit was of a horizontal type of separately applying liquid onto both faces and was the same as that disclosed in Japanese Unexamined Patent Application Publication No. 62-133084. For the steel sheets coated using the horizontal coating unit, only a face of each steel sheet coated using a coater placed closer to a dryer section were evaluated.

The coated steel sheets were dried and baked using a high-frequency induction heater (80 kHz) for performing a drying operation and baking operation in one step. After the steel sheet temperature was increased to 100° C., the heating rate was the same as that for heating the steel sheets to 100° C. In the vertical line, the heater for drying and baking was placed in a vertical manner, that is, the heater was placed directly above the coating unit. In the horizontal line, the heater for drying and baking was placed in a horizontal manner, that is, the heater was placed downstream the coating unit.

The drying time was controlled based on the conveying speed and by varying the electricity supplied to the dryer, and the arrangement of pass lines and the apparatuses was changed according to needs. In existing facilities in which the apparatuses were not closely arranged or which were not modified so as to correspond to high-speed operations, the time elapsed until each steel sheet was placed in the dryer (furnace) after the application was completed was about 3-20 seconds or more.

Obtained results are shown in Tables 2-1 and 2-2. Standards for evaluation are as shown in Table 3.

TABLE 2-1

| No. | Inorganic Component | Ratio of Inorganic Component to Resin to Ethylene Glycol | Coating Line | Drying Time (s) Details *1 | Drying Time (s) Total | Baking Temp. (° C.) | Evaluation of Uneven Coating *2 |
|---|---|---|---|---|---|---|---|
| 1 | Aluminum Dichromate | 60:20:20 | Vertical | 4/8, 6/6, 9/3 | 12 | 250 | 2 |
| 2 | Aluminum Dichromate | " | " | 3/7, 5/5, 8/2 | 10 | 200 | 3-4 |
| 3 | Aluminum Dichromate | " | " | 2/6, 4/4, 6/2 | 8 | 200 | 4 |
| 4 | Aluminum Dichromate | " | " | 2/4, 3/3, 5/1 | 6 | 180 | 5 |
| 5 | Aluminum Dichromate | " | " | 4/8, 6/6, 9/3 | 12 | 250 | 2 |
| 6 | Aluminum Dichromate | " | Horizontal | 3/7, 5/5, 8/2 | 10 | 200 | 4 |
| 7 | Aluminum Dichromate | " | " | 2/6, 4/4, 6/2 | 8 | 200 | 5 |
| 8 | Aluminum Dichromate | " | " | 2/4, 3/3, 5/1 | 6 | 180 | 5 |
| 9 | Aluminum primary phosphate and Chromic Anhydride (70:30) | 70:30:0 | Vertical | 4/8, 6/6, 9/3 | 12 | 300 | 1 |
| 10 | Aluminum primary phosphate and Chromic Anhydride (70:30) | " | " | 3/7, 5/5, 8/2 | 10 | 300 | 3 |
| 11 | Aluminum primary phosphate and Chromic Anhydride (70:30) | " | " | 2/6, 4/4, 6/2 | 8 | 300 | 4 |
| 12 | Aluminum primary phosphate and Chromic Anhydride (70:30) | " | " | 2/4, 3/3, 5/1 | 6 | 300 | 5 |

TABLE 2-2

| No. | Inorganic Component | Ratio of Inorganic Component to Resin to Ethylene Glycol | Coating Line | Drying Time (s) Details *1 | Drying Time (s) Total | Baking Temp. (° C.) | Evaluation of Uneven Coating *2 |
|---|---|---|---|---|---|---|---|
| 13 | Aluminum primary phosphate and Chromic Anhydride (70:30) | 70:30:0 | Horizontal | 4/8, 6/6, 9/3 | 12 | 300 | 2 |
| 14 | Aluminum primary phosphate and Chromic Anhydride (70:30) | " | " | 3/7, 5/5, 8/2 | 10 | 300 | 4 |
| 15 | Aluminum primary phosphate and Chromic Anhydride (70:30) | " | " | 2/6, 4/4, 6/2 | 8 | 300 | 4-5 |
| 16 | Aluminum primary | " | " | 2/4, 3/3, 5/1 | 6 | 300 | 5 |

TABLE 2-2-continued

| No. | Inorganic Component | Ratio of Inorganic Component to Resin to Ethylene Glycol | Coating Line | Drying Time (s) Details *1 | Drying Time (s) Total | Baking Temp. (° C.) | Evaluation of Uneven Coating *2 |
|---|---|---|---|---|---|---|---|
| | phosphate and Chromic Anhydride (70:30) | | | | | | |
| 17 | Silica Containing Alumina (colloid) | 50:50:0 | Vertical | 4/8, 6/6, 9/3 | 12 | 200 | 1 |
| 18 | Silica Containing Alumina (colloid) | " | " | 3/7, 5/5, 8/2 | 10 | 150 | 3 |
| 19 | Silica Containing Alumina (colloid) | " | " | 2/6, 4/4, 6/2 | 8 | 150 | 4 |
| 20 | Silica Containing Alumina (colloid) | " | " | 2/4, 3/3, 5/1 | 6 | 150 | 5 |
| 21 | Silica Containing Alumina (colloid) | " | Horizontal | 4/8, 6/6, 9/3 | 12 | 200 | 2 |
| 22 | Silica Containing Alumina (colloid) | " | " | 3/7, 5/5, 8/2 | 10 | 150 | 4 |
| 23 | Silica Containing Alumina (colloid) | " | " | 2/6, 4/4, 6/2 | 8 | 150 | 4-5 |
| 24 | Silica Containing Alumina (colloid) | " | " | 2/4, 3/3, 5/1 | 6 | 150 | 5 |
| 25 | Silica Containing Alumina (colloid) | " | Vertical | 2/2, 3.5/0.5 | 4 | 150 | 5 |
| 26 | Silica Containing Alumina (colloid) | " | Horizontal | 2/2, 3.5/0.5 | 4 | 150 | 5 |

*1 Time elapsed until sample is placed in furnace after the application (s)/Time elapsed until sample temperature is increased to 100° C. after the start of heating (s) (In each test, two or three conditions were examined.)
*2 See Table 3.

TABLE 3

| Rating | Evaluation of Uneven Coating |
|---|---|
| 1 | Unevenness is extremely serious. |
| 2 | Unevenness is serious. |
| 3 | Unevenness is slight. |
| 4 | Unevenness is hardly observed. Good. |
| 5 | No unevenness is observed. Very good. |

Tables 2-1 and 2-2 shows that the heating time during heating operation is a subsidiary factor and the drying time until water is removed after the start of heating is a critical factor, wherein the heating time has seemed to have an influence on surface properties of coatings. In particular, when the drying time is 10 seconds or less, coating unevenness is obviously slight for every coating liquid although there is a small difference in coating unevenness depending on the inorganic component (for example, the dichromate coating liquids are more effective in avoiding the coating unevenness as compared with the other coating liquids). Furthermore, when the drying time is 8 seconds or less, the following great advantage is obtained: the coatings having a rating of 4, which means that the surface properties are excellent, can be obtained in a reproducible manner using the vertical coating line, in which the coating unevenness is apt to arise, without depending on the inorganic component. Furthermore, when the drying time is 6 seconds or less, the following greater advantage is obtained: the coatings having a rating of 5, which means that the surface properties are the highest, can be obtained in a reproducible manner using the vertical coating line without depending on the inorganic component.

Results of experiments for obtaining the relationship between the formation of the flash rust and the drying time are described below.

Figure 3:
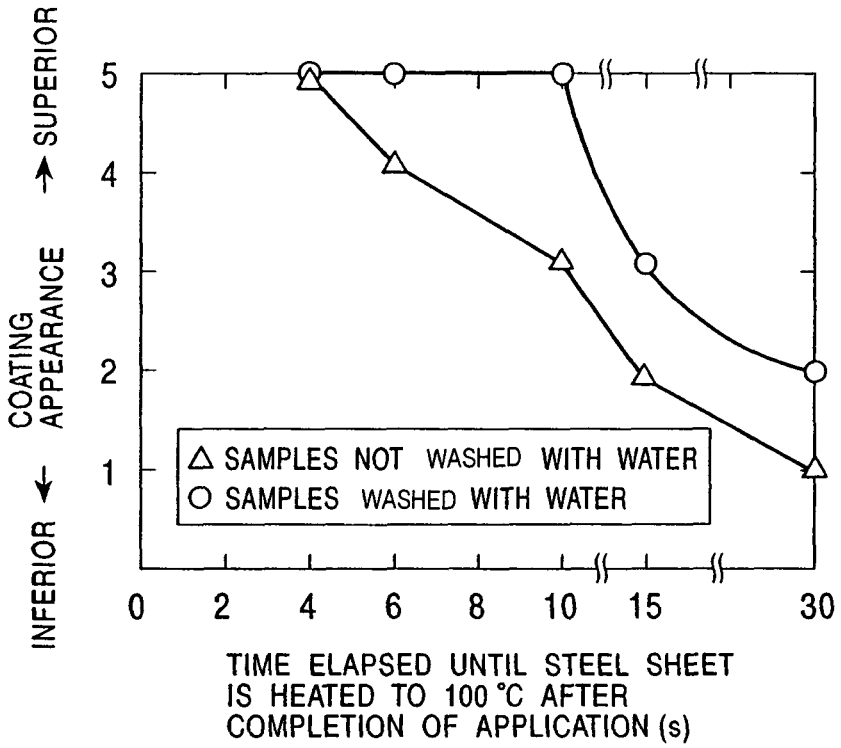
FIG. 3 is a graph showing the relationship between the time elapsed until the temperature of a steel sheet reaches 100° C. after the application of a water-based coating liquid is completed and the formation of flash rust.

In an atmosphere in which the ratio of $H_2$ to $N_2$ is 30:70 (on a volume basis), 100 t of cold-rolled steel sheets having a thickness of 0.5 mm were annealed at 900° C. Some of the resulting steel sheets were washed with water and the other steel sheets were not washed. Water-based coating liquids were then each applied onto the corresponding steel sheets using a roll coater, wherein the water-based coating liquids contains water and 5 mass % of a coating component (the composition of a combination of a solute and dispersoid is 40 mass % of a resin and 60 mass % of silica containing alumina). The following relationship, which is shown in FIG. 3, was investigated depending on whether the annealed steel sheets were washed with water: the relationship between the formation of the flash rust and the time elapsed until the steel sheet temperature is increased to 100° C. after the application is completed (this time includes a period of 2 seconds elapsed until the heating is started after the application is completed). The resin used was an acrylic and styrene copolymer (a glass transition point Tg of 25° C.). The steel sheet temperature (temperature of the steel sheets each placed at a position before the input portion of a coating unit) was 30° C. when the steel sheets were coated. The resulting steel sheets were then baked and the heating rate was 10° C./s while the steel sheet temperature was increased from 100 to 200° C. The coating thickness (the area weight per face in a dry state) was 1.5 $g/m^2$. The evaluation of the formation of the flash rust used in FIG. 3 is as shown in Table 4.

Slabs used for manufacturing the steel sheets had the following composition: 0.003 mass % of C, 1.2 mass % of Si, 0.15 mass % of Mn, and 0.5 mass % of Al, the remainders being iron and unavoidable impurities. The resin in the coating liquid was emulsified, and dispersed resin particles had an average size of 300 nm. A roll coater used was of a vertical type of simultaneously applying liquid onto both faces and was the same as that disclosed in Japanese Unexamined Patent Application Publication No. 11-262710. The coated steel sheets were dried and baked using a high-frequency induction heater (80 kHz) for performing a drying operation and baking operation in one step.

TABLE 4

| Rating | Formation of Flash Rust |
|---|---|
| 1 | Flash rust covers 50% or more of a surface. |
| 2 | Flash rust covers 10-50% of a surface. |
| 3 | Flash rust covers a small area (10% or less of a surface). |
| 4 | Flash rust is hardly formed. |
| 5 | No flash rust is formed. |

FIG. 3 shows that the flash rust is hardly formed when the drying time elapsed until the steel sheet temperature is increased to 100° C. after the application of each water-based coating liquid is completed in 10 seconds or less and substantially no flash rust is formed on the washed steel sheets in particular. For the non-washed steel sheets, the flash rust is obviously slight when the drying time is 6 seconds or less, and no flash rust is observed when the drying time is 5 seconds or less.

As described above, the flash rust can be prevented from being formed by decreasing the drying time elapsed until the steel sheet temperature is increased to 100° C. after the application of the water-based coating liquid is completed and by washing the steel sheets with water in preferable. The mechanism of the above phenomenon, which is not necessarily clear, is presumed to be as follows: a decrease in drying time, elapsed after the application of the water-based coating liquid is completed, decreases the elusion of Fe from the steel sheet surfaces activated by the annealing operation and a small amount of hydroxides formed in the water-washing operation deactivate the active steel sheet surfaces, thereby preventing Fe from migrating into the coating liquid. The flash rust is not formed in usual when the water-based coating liquid contains a sufficient amount of a passivator such as chromium or the like.

In order to dry the coatings, the coatings are heated on the side close to the steel sheets (the lower face of each coating, that is, the inner face thereof). That is, it is important to heat the coatings using heat generated from the steel sheets.

When, for example, an air(gas)-heating furnace is used to dry the coatings, a strong hot air(gas) blast is applied to the coatings in order to heat the coatings rapidly and therefore appearance defects such as wind patterns are seriously caused. In contrast, when the coatings are heated due to heat generated from the steel sheets heated with, for example, an induction heater, the coatings can be dried by desired rapid heating method without causing the above problems.

In a method for heating the coatings by applying external radiation heat using, for example, an electric furnace, surface portions of the coatings are dried in advance when the heating rate is excessively high (for example, the heating rate exceeds about 20° C/s), whereby appearance defects such as blister are caused because substances having a low boiling point remain in the coatings. In contrast, in a method for heating the coatings on the side close to our steel sheets, the lower portions of the coatings are dried in advance and therefore such substances having a low boiling point are effectively removed from the coatings. Thus, as far as we have confirmed, no appearance defects are caused by a super high-speed drying operation (or baking operation) in which the heating rate does not exceed about 150° C/s. When this method is used for forming insulating films for electromagnetic steel sheets, the substances having a low boiling point can be removed and therefore the weldability can be improved.

In order to make a comparison with our process, experiments were performed under the same conditions shown in Tables 2-1 and 2-2 except that the heating method of the drying step is varied. Obtained results are shown in Table 5. Evaluation standards are as shown in Table 3.

TABLE 5

| No. | Inorganic Component (s) | Coating Line | Drying Time (s) Details *1 | Drying Time (s) Total | Drying Unit | Baking Temp. (° C.) | Evaluation of Uneven Coating *2 |
|---|---|---|---|---|---|---|---|
| 27 | Magnesium Dichromate | Vertical | 2/4 | 6 | IR Furnace | 280 | 2 |
| 28 | " | " | 2/6 | 8 | Air (gas) - Heating Furnace | 280 | 1 |
| 29 | " | Horizontal | 2/4 | 6 | IR Furnace | 280 | 3 |
| 30 | " | " | 2/6 | 8 | Air (gas) - Heating Furnace | 280 | 1 |
| 31 | Silica containing alumina (Colloid) | Vertical | 2/4 | 6 | IR Furnace | 200 | 1 |
| 32 | " | " | 2/6 | 8 | Air (gas) - Heating Furnace | 200 | 1 |
| 33 | " | Horizontal | 2/4 | 6 | IR Furnace | 200 | 2 |

TABLE 5-continued

| No. | Inorganic Component (s) | Coating Line | Drying Time (s) Details *1 | Drying Time (s) Total | Drying Unit | Baking Temp. (° C.) | Evaluation of Uneven Coating *2 |
|---|---|---|---|---|---|---|---|
| 34 | " | " | 2/6 | 8 | Air (gas) - Heating Furnace | 200 | 1 |

*1 Time elapsed until sample is placed in furnace after the application (s)/Time elapsed until sample temperature is increased to 100° C. after the start of heating (s)
*2 See Table 3.

Table 5 shows that the coating unevenness is caused by methods different from the method for heating the coatings on the side close to the steel sheets even if the drying time is short. Furthermore, the coating unevenness becomes serious as the case may be, due to rapid heating.

The method for drying the coatings by heating the coatings on the side close to the steel sheets is remarkably effective in improving punchability and corrosion resistance of temper-rolled steel sheets (described below) as compared with the methods for heating the coating surface (weldability thereof are also improved by heating the coatings on the side close to the steel sheets during the drying). The mechanism of this phenomenon is not necessarily clear; however, we consider the mechanism to be as described below.

(1) When the lower portions of the coatings are heated, convection occurs in the coatings that have not solidified and therefore the resin particles dispersed in the coatings are concentrated at surface portions of the coatings. As a result, the resin content is increased at the surface portions, thereby enhancing the punchability.

(2) When faces of the steel sheets are heated, the resin is concentrated at the surface portions and therefore the surfaces of the coatings do not crack even if the coated steel sheets are temper-rolled at a reduction ratio of about 10% or less, whereby the corrosion resistance of the coating is not deteriorated.

A known method may be used in the baking operation performed after the drying operation; however, the method for heating the coatings on the side close to the steel sheets is preferably used in the baking operation in order to ensure the line speed. The drying operation and baking operation may be performed in one heating unit.

The method for heating the coatings on the side close to the steel sheets includes an induction heating method in which eddy currents generated by allowing induced currents to flow in the steel sheets are used for heating the steel sheets as an advantageous method. In the induction heating method, the frequency and the heating rate are not particularly limited and may be appropriately determined depending on the heating time and efficiency limited by the apparatus performance and properties (thickness, permeability, and the like) of the electromagnetic steel sheets. In view of the heating rate, high-frequency heating is particularly preferable.

In addition to the above method, there is a method for heating the steel sheets by directly applying currents to the steel sheets. The induction heating method is most fit for homogeneous heating among known methods at present.

The heating rate and maximum heating temperature may be appropriately determined depending on the type of the coating liquid and the uses of the steel sheets. The heating temperature, namely, the maximum temperature achieved is defined as a temperature necessary for forming the coatings and is preferably about 100-350° C. because the water-based coating liquids are used. This is because water tends to remain in the coatings when the maximum temperature is less than about 100° C., and therefore the water content of the coating liquid is limited. Furthermore, there is a fear that the resin is thermally decomposed when the maximum temperature exceeds about 350° C. depending on the resin. The maximum temperature more preferably ranges about 150 to about 350° C.

For the electromagnetic steel sheets, in order to render the insulating films uniformly formed, the films preferably have an area weight of about 0.05 g/m$^2$ or more on a dry basis. On the other hand, since an increase in area weight deteriorates the adhesion of the films, the area weight is preferably about 7.0 g/m$^2$ or less. That is, the area weight preferably ranges about 0.05 to about 7.0 g/m$^2$ on a dry basis. The area weight can be determined by comparing the weight of each steel sheet having each insulating film thereon between that of the steel sheet from which the insulating film has been removed using alkali. The area weight may be determined by another method as long as the same accuracy as that of the above method can be achieved.

A species of electromagnetic steel sheet, for example, the nonoriented electromagnetic steel sheet delivered in the semi-processed state is temper-rolled at a reduction rate of about 10% or less before or after the coating operation (the formation of an insulating film) is performed. In general, the temper-rolling is performed before the formation of the insulating film in many cases, and such a procedure is preferable. In recent years, the final annealing step performed before the coating step and steps subsequent to the final annealing step are performed using a series of integrated apparatuses in many cases. In that case, no problems arise when a continuous annealing apparatus, a temper-rolling apparatus, and a coating unit are arranged in that order. However, it is not preferable that the temper-rolling apparatus is not placed in the arrangement, that is, the temper-rolling apparatus is placed in another line. This is because the film properties are deteriorated when the steel sheet is continuously annealed and then coated in one line and subsequently temper-rolled in another line. In order to avoid that problem, after the steel sheet is continuously annealed in a first line and then temper-rolled in a second line, the resulting steel sheet must be returned to the first line or coated in another line. In both cases, manufacturing cost is high.

Since a water-based coating liquid containing a resin and inorganic component is heated on the side close to a steel sheet and then baked, the resin is concentrated at the surface, thereby enhancing the punchability. Therefore, if the insulating film is formed on the steel sheet and the resulting steel sheet is temper-rolled, the corrosion resistance can be prevented from being deteriorated; hence, no problems on quality arise.

That is, when a known insulating film containing organic and inorganic components is formed on the steel sheet using a continuous line including a continuous annealing apparatus, a roll coater for application, and an air(gas)-heating furnace for drying and baking and the resulting steel sheet is temper-rolled at a reduction ratio of about 8%, the corrosion resistance is. deteriorated. In the observation of the surface of the steel sheet having an inferior corrosion resistance using a microscope, cracks on the surface are observed. This is because the elongation of the steel sheet is excessively large as compared with that of the insulating film and therefore the film cracks, thereby causing a deterioration in corrosion resistance.

In the investigation of that problem, when an inorganic insulating film and organic insulating film are treated in the same manner as the above, the inorganic insulating film is seriously deteriorated in corrosion resistance but the organic insulating film is hardly deteriorated in corrosion resistance. In the microscopic observation of the steel sheet surface, there are no appearance defects on the organic insulating film but there are many cracks on the inorganic insulating film.

According to the above fact, in order to obtain an insulating film that can endure the temper-rolling operation, it seems to be preferable to increase the resin content in the film. However, an increase in resin content is not preferable in view of weldability that are important in TIG welding and the like. Furthermore, since resin is thermally decomposed during a stress relief annealing operation, an increase in resin content in the film causes a deterioration in film property during the stress relief annealing operation. From this viewpoint, an increase in resin content is not preferable.

However, in the method for heating the film on the side close to the steel sheet during the baking of the film, since the resin is concentrated at the surface of the film, the corrosion resistance and punchability can be prevented from being deteriorated during the temper-rolling operation without causing a decrease in weldability and space factor and a deterioration in film property after the stress relief annealing operation.

For the temper-rolled steel sheet, since the growth of crystal grains is promoted during the stress relief annealing operation performed by users, magnetic properties thereof are improved. However, when the reduction ratio of the temper-rolling operation exceeds about 10%, an improvement in magnetic property tends to saturated. Furthermore, when the steel sheet is temper-rolled at an excessively high reduction ratio, there is a fear that the corrosion resistance is deteriorated even if the insulating film is baked by heating the film on the side close to the steel sheet. Thus, the upper limit of the reduction rate is about 10% or less. In order to obtain advantages of temper-rolling, the reduction rate is preferably about 1% or more.

EXAMPLES

Advantages of our process will now be described with reference to examples in detail. The process is not limited to such examples.

Example 1

Steel ingots for manufacturing cold-rolled steel sheets were manufactured and then hot-rolled, and the hot-rolled steel sheets were annealed according to needs. The resulting steel sheets were cold-rolled, thereby obtaining cold-rolled steel strips having a thickness of 0.5 mm, a width of 1 m, and a surface roughness Ra of 0.3 μm. The cold-rolled steel strips were then annealed at 900° C. in an atmosphere in which the ratio of $H_2$ to $N_2$ is 30:70. Water-based coating liquids having composition shown in Tables 6-1 and 6-2 were each applied onto corresponding steel sheets. Conditions of the application and drying and baking conditions are shown in Table 7 together with evaluation results of obtained products. The coating thickness (the area weight per face on a dry basis) was 0.1-6 g/m$^2$. The area weight was adjusted by varying concentration of the coating liquid (0.5 to 30 mass %).

The steel sheets had the following composition: 0.012 mass % of C, 0.009 mass % of Si, 0.14 mass % of Mn, and 0.032 mass % of Al, the remainders being subsidiary elements and iron.

The adhesion of resin to a roll coater was evaluated after 100 t of the steel sheets were processed. The roll coater used was of a vertical type of simultaneously applying liquid onto both faces and was the same as that disclosed in Japanese Unexamined Patent Application Publication No. 11-262710. A high-frequency induction heater (80 kHz) including a drying unit and baking unit vertically arranged in an integrated manner was used. After the steel sheet temperature was increased to 100° C., the heating rate was the same as that for heating the steel sheets to 100° C.

The flash rust and coating unevenness were evaluated based on the standards shown in Tables 4 and 3.

TABLE 6-1

| No. | Resin | State of Resin | Resin Particle Size (μm) | Glass Transition Point Tg (° C.) | Composition of Combination of Solute and Dispersoid (mass %) | Total Solute and Dispersoid Content (mass %) |
|---|---|---|---|---|---|---|
| 1 | Acrylic/ Styrene | Emulsion | 0.1 | 40 | 15% Resin, 55% Aluminum Dichromate, 15% Aluminum primary phosphate, and 15% Ethylene Glycol | 20 |
| 2 | Acrylic/ Styrene | " | 0.1 | 0 | 20% Resin, 50% Magnesium Dichromate, 15% Boric Acid, and 15% Ethylene Glycol | 10 |
| 3 | Acrylic/ Epoxy | " | 0.4 | 90 | 100% Resins | 30 |
| 4 | Epoxy | " | 0.5 | — | 50% Silica containing alumina and 50% Resins | 5 |

TABLE 6-1-continued

| No. | Resin | State of Resin | Resin Particle Size (μm) | Glass Transition Point Tg (° C.) | Composition of Combination of Solute and Dispersoid (mass %) | Total Solute and Dispersoid Content (mass %) |
|---|---|---|---|---|---|---|
| 5 | Acrylic/ Styrene | " | 0.1 | 25 | 10% Resin, 60% Aluminum primary phosphate, 15% Boric Acid, and 15% Chromate Anhydride | 0.5 |
| 6 | Acrylic/ Styrene | " | 0.1 | 40 | 15% Resin, 55% Aluminum Dichromate, 15% Aluminum primary phosphate, and 15% Ethylene Glycol | 3 |
| 7 | Epoxy | " | 0.5 | — | 100% Resin | 20 |
| 8 | Epoxy | " | 0.5 | — | 50% Silica containing alumina and 50% Resins | 15 |

TABLE 6-2

| No. | Resin | State of Resin | Resin Particle Size (μm) | Glass Transition Point Tg (° C.) | Composition of Combination of Solute and Dispersoid (mass %) | Total Solute and Dispersoid Content (mass %) |
|---|---|---|---|---|---|---|
| 9 | Acrylic/ Styrene | Emulsion | 0.1 | 10 | 20% Resin, 50% Magnesium Dichromate, 15% Boric Acid, and 15% Ethylene Glycol | 7 |
| 10 | Epoxy | " | 0.5 | — | 50% Silica containing alumina and 50% Resins | 10 |
| 11 | Epoxy | Dispersion | 0.5 | — | 50% Resin and 50% Silica containing alumina | 8 |
| 12 | Acrylic/ Styrene | Powder | 1 | — | 30% Resins, 50% Magnesium Chromate, and 20% Ethylene Glycol | 15 |

TABLE 7

| No. | Water Washing | Steel Sheet Temp. (° C.) | Tg + 20° C. (° C.) | Adhesion of Resin | Time Elapsed Until Temperature is Increased to 100° C. Details *1 | Total | Baking Temp. (° C.) | Formation of Flash Rust *2 | Evaluation of Uneven Coating *3 | Remarks |
|---|---|---|---|---|---|---|---|---|---|---|
| 1 | Performed | 40 | 60 | 5 | 3/2 | 5 | 200 | 5 | 5 | Example |
| 2 | Performed | 20 | 20 | 4 | 2/6 | 8 | 300 | 5 | 4 | Example |
| 3 | Performed | 60 | 110 | 5 | 3/3 | 6 | 250 | 5 | 5 | Example |
| 4 | Performed | 50 | — | 5 | 5/5 | 10 | 150 | 4 | 3 | Example |
| 5 | Performed | 40 | 45 | 4 | 3/4 | 7 | 300 | 5 | 4 | Example |
| 6 | Performed | 80 | 60 | 2 | 3/4 | 7 | 200 | 5 | 4 | Example |
| 7 | Performed | 90 | — | 2 | 3/4 | 7 | 280 | 5 | 4 | Example |
| 8 | Performed | 50 | — | 5 | 5/7 | 12 | 150 | 3 | 1 | Comparative Example |
| 9 | Performed | 40 | 30 | 3 | 3/2 | 5 | 300 | 5 | 5 | Example |
| 10 | Not Performed | 50 | — | 5 | 5/7 | 12 | 150 | 2 | 1 | Comparative Example |
| 11 | Performed | 40 | — | 5 | 3/2 | 5 | 180 | 5 | 5 | Example |
| 12 | Performed | 40 | 80 | 5 | 3/2 | 5 | 300 | 5 | 5 | Example |

*1 Time elapsed until sample is placed in furnace after application (s)/Time elapsed until sample temperature is increased to 100° C. after start of heating (s)
*2 See Table 4.
*3 See Table 3.

As shown in Table 7, in the samples prepared by annealing the steel sheets, applying the water-based coating liquids onto the resulting steel sheets, and then drying the resulting steel sheets within 10 seconds according to a procedure of our process, the coating unevenness is remarkably slight. When the drying time is 8 seconds or 6 seconds, an improvement in coating unevenness is more remarkable. In the samples prepared by annealing the steel sheets, washing the resulting steel sheets, applying the water-based coating liquids onto the resulting steel sheets, and then drying the resulting steel sheets, the formation of flash rust is not observed. Furthermore, when the steel sheet temperature is lower than or equal to a temperature 20° C. higher than the glass transition point (Tg) of the resins each contained in the corresponding water-based coating liquids, the resins can be prevented from being adhered to the coater.

Example 2

According to a known procedure, steel slabs having predetermined composition were subjected to hot-rolling, and the hot-rolled steel sheets were subjected to annealing, cold-rolling, intermediate annealing, cold-rolling, and then finish annealing in that order, thereby obtaining nonoriented electromagnetic steel sheets (steel sheets to be treated) having a thickness of 0.5 mm and a surface roughness Ra of 0.4 μm. The steel sheets had the following component: 0.35 mass % of Si, 0.001 mass % of Al, and 0.1 mass % of Mn, the remainders being Fe and unavoidable impurities. The ultimate temperatures achieved in the annealing operation of the hot-rolled steel sheets, the intermediate annealing operation, and the finish annealing operation were 1000° C., 900° C., and 1000° C., respectively.

The electromagnetic steel sheets were cooled to 30° C. Each water-based coating liquid containing solutes and dispersoids (the ratio of water to the total solute and dispersoid amount is 95:5 on a mass basis) was then applied onto surfaces (both faces) of each electromagnetic steel sheet using a roll coater. A combination of the solutes and dispersoids had the following composition: 50 mass % of magnesium dichromate, 20 mass % of an acrylic and styrene resin emulsion (a particle size of 200 nm and a glass transition point Tg of 20° C.), 15 mass % of boric acid, and 15 mass % of ethylene glycol. The resulting steel sheets were heated by an induction heating method or a heating method using an air(gas)-heating furnace such that the steel sheets were dried and baked at an ultimate temperature of 300° C. Thereby, each insulating film having an area weight of 1.0 g/m$^2$ on a dry basis was formed on each face. The annealed steel sheets were not washed with water before the application. A coating unit used was of a vertical type of simultaneously applying coating liquid onto both faces and was the same as that disclosed in Japanese Unexamined Patent Application Publication No. 11-262710. The coating operation was performed in a vertical line. The time elapsed until each steel sheet was placed in a drying unit after the application was completed was adjusted to 3 seconds.

In the induction heating method, the frequency was 30 kHz, the heating rate was varied by changing the input electricity, and the maximum temperature achieved was 300° C. When the air(gas)-heating furnace was used, the temperature was increased to 300° C. during 30 seconds (an average heating rate of 9° C./s). In the air(gas)-heating furnace, serious appearance defects arose when the heating rate was higher than the above.

Figure 4A:
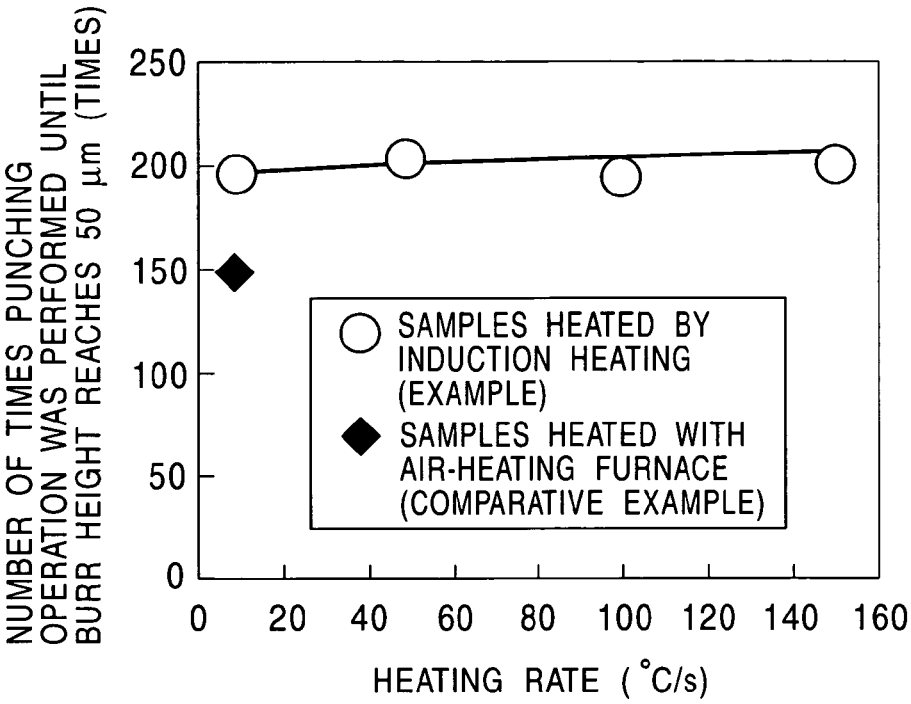
FIG. 4A is a graph showing the relationship between the heating rate of a baking operation of Example 2 and the number of times a punching operation is performed until the burr height reaches 50 μm.
Figure 4B:
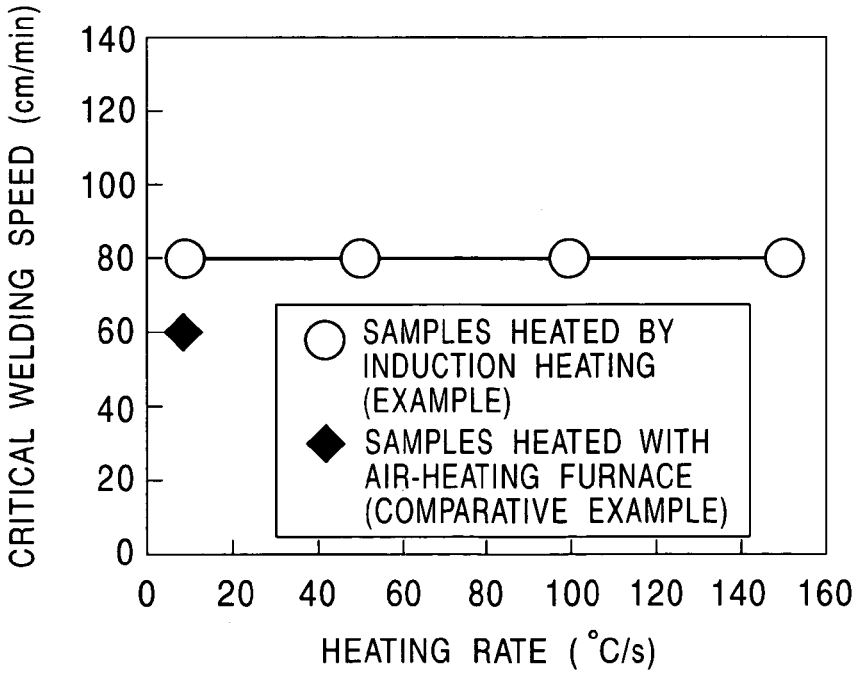
FIG. 4B is a graph showing the relationship between the heating rate of the baking operation of Example 2 and the critical welding speed.

The electromagnetic steel sheets, obtained according to the above procedure, each having the corresponding insulating films thereon were examined for a punchability and weldability. Obtained results are shown in FIGS. 4A and 4B for comparison.

The punchability and weldability were evaluated as below.

Weldability

The steel sheets were stacked so as to reach a height of 3 cm. End faces of the stacked steel sheets were subjected to TIG welding under the conditions below. The weldability of the steel sheets was evaluated based on the maximum welding speed that causes no blowholes.

Electrodes: Th-W, 2.6 mmΦ, (thorium-tungsten)
Pressure: 10 N/mm$^2$
Current: 120 A
Shielding Gas: Ar (6 L/min)

Punchability

A die was adjusted such that the initial burr height is 10 μm, and a punching test was continuously repeated under the conditions below, thereby determining the number of times a punching operation was repeated until the burr height reaches 50 μm.

Die: 15 mmΦ steel die
Clearance: 5%
Punching Speed: 500 hits per minute
Punching Oil: Punching Oil for Silicon Steel Sheets (Daphne New Punch Oil, manufactured by Idemitsu Kosan Co., Ltd., having the following typical values: a kinetic viscosity of 1.3 mm$^2$/s at 40° C., a density of 0.77 g/m$^3$ at 15° C., and a coefficient of friction of 0.13 at room temperature)

As shown in FIGS. 4A and 4B, the samples of this example that are the electromagnetic steel sheets having the insulating films thereon dried and baked on the side close to the steel sheets (by the induction heating method) are superior in punchability and weldability without depending on the heating rate as compared with the samples of a comparative example.

Example 3

Nonoriented electromagnetic steel sheets (steel sheets to be treated) having a thickness of 0.35 mm and a surface roughness Ra of 0.3 μm were obtained according to the same procedure as that of Example 1. The steel sheets had the following composition: 3.0 mass % of Si, 0.001 mass % of Al, and 0.1 mass % of Mn, the remainders being Fe and unavoidable impurities.

The electromagnetic steel sheets were cooled to 40° C. Each water-based coating liquid containing solutes and dispersoids (the ratio of water to the total solute and dispersoid amount is 95:5 on a mass basis) was then applied onto surfaces (both faces) of each electromagnetic steel sheet using a roll coater. A combination of the solutes and dispersoids had the following composition: 60 mass % of colloidal silica and 40 mass % of an epoxy resin dispersion (a particle size of 500 nm). The resulting steel sheets were heated by an induction heating method or a heating method using an air(gas)-heating furnace such that the steel sheets were dried and baked at an ultimate temperature of 200° C. Thereby, each insulating film having an area weight of 0.8 g/m$^2$ on a dry basis was formed on each face. Other coating conditions were the same as those of Example 2.

When the air(gas)-heating furnace was used, the temperature was increased to 200° C. during 30 seconds (an average heating rate of 6° C./s). In the induction heating method, the frequency was 80 kHz, the heating rate was varied by changing the input electricity, and the maximum temperature achieved was 200° C.

The electromagnetic steel sheets, obtained according to the above procedure, each having the corresponding insulating films thereon were examined for the punchability and weldability. Obtained results are shown in FIGS. 5A and 5B for comparison.

Figure 5A:
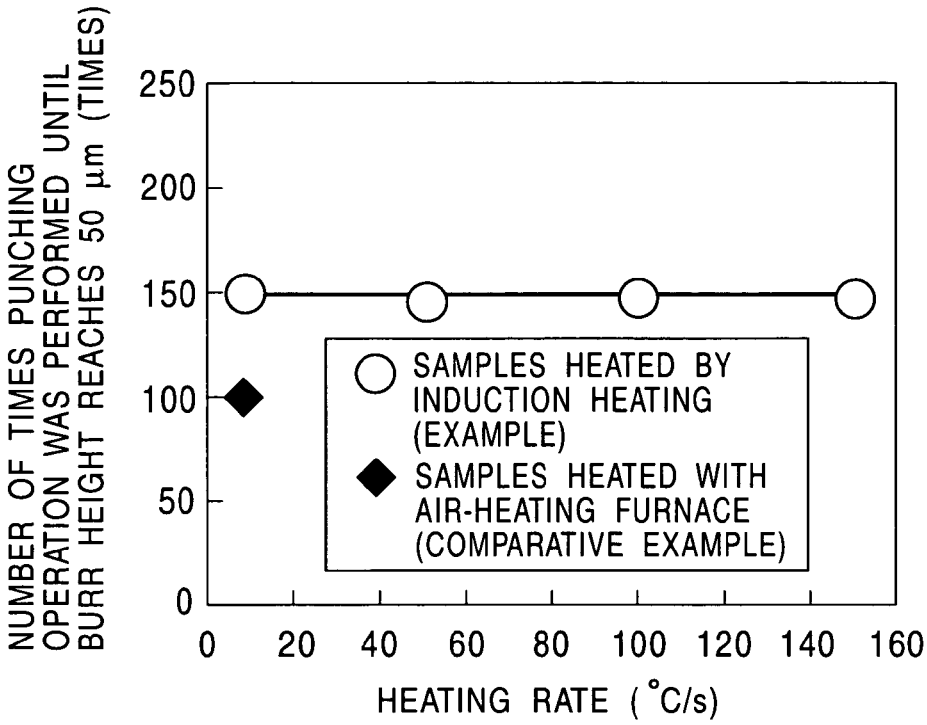
FIG. 5A is a graph showing the relationship between the heating rate of a baking operation of Example 3 and the number of times a punching operation is performed until the burr height reaches 50 μm.
Figure 5B:
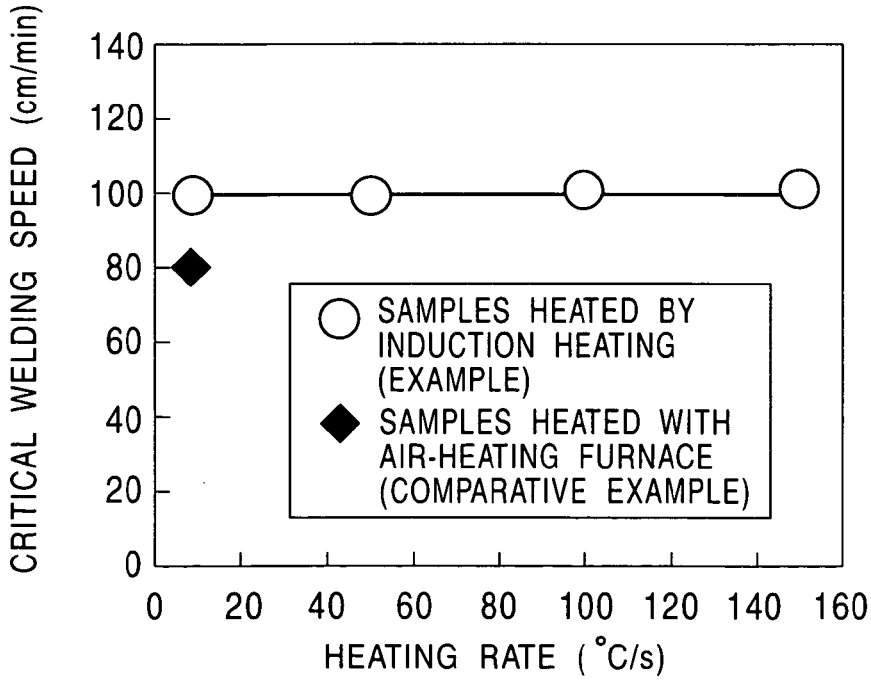
FIG. 5B is a graph showing the relationship between the heating rate of the baking operation of Example 3 and the critical welding speed.

As shown in FIGS. 5A and 5B, the samples of this example that are the electromagnetic steel sheets having the insulating films thereon dried and baked on the side close to the steel sheets (by the induction heating method) are superior in punchability and weldability without depending on the heating rate as compared with the samples of a comparative example.

Example 4

Nonoriented electromagnetic steel sheets (steel sheets to be treated) having a thickness of 0.5 mm and a surface roughness Ra of 0.3 μm were obtained according to the same procedure as that of Example 1. The steel sheets had the following composition: 1.2 mass % of Si, 0.2 mass % of Al, and 0.1 mass % of Mn, the remainders being Fe and unavoidable impurities.

The electromagnetic steel sheets were cooled to 20° C. Each water-based coating liquid containing solutes and dispersoids (the ratio of water to the total solute and dispersoid amount is 95:5 on a mass basis) was then applied onto surfaces (both faces) of each electromagnetic steel sheet using a roll coater. A combination of the solutes and dispersoids had the following composition: 50 mass % of aluminum primary phosphate, 15 mass % of potassium dichromate, 30 mass % of an acrylic-vinyl acetate resin emulsion (a particle size of 100 nm and a glass transition point Tg of 20° C.), and 5 mass % of boric acid. The resulting steel sheets were heated by an induction heating method or a heating method using an air(gas)-heating furnace such that the steel sheets were dried and baked at an ultimate temperature of 300° C. Thereby, each insulating film having an area weight of 1.2 g/m$^2$ on a dry basis was formed on each face. Other coating conditions were the same as those of Example 2.

When the air(gas)-heating furnace was used, the temperature was increased to 300° C. during 30 seconds (an average heating rate of 9° C./s). In the induction heating method, the frequency was 30 kHz, the heating rate was varied by changing the input electricity, and the maximum temperature achieved was 300° C.

The electromagnetic steel sheets, obtained according to the above procedure, each having the corresponding insulating films thereon were examined for the punchability and weldability. Obtained results are shown in FIGS. 6A and 6B for comparison.

Figure 6A:
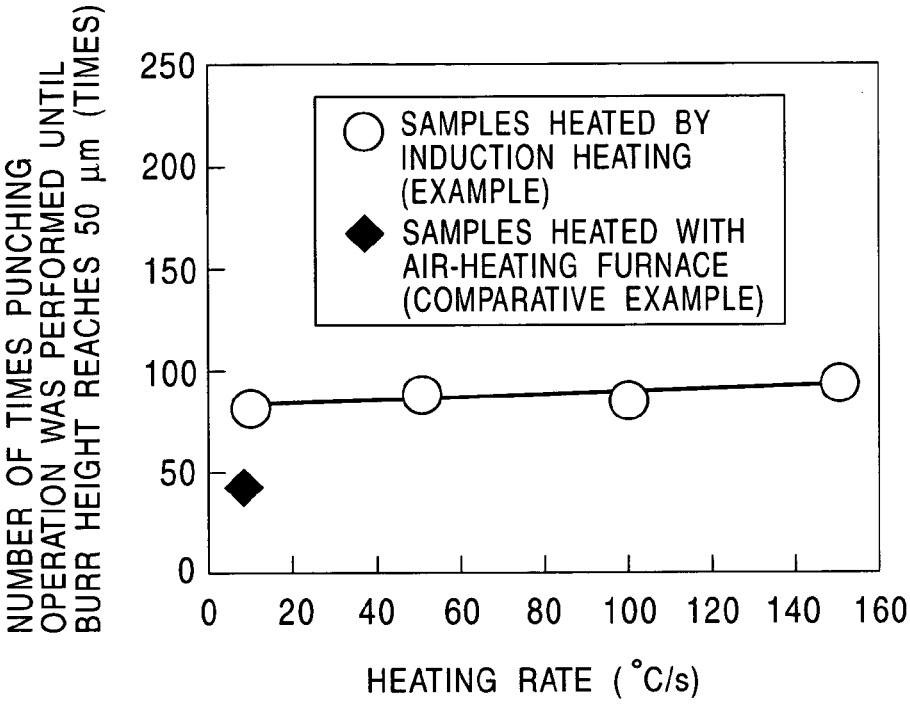
FIG. 6A is a graph showing the relationship between the heating rate of a baking operation of Example 4 and the number of times a punching operation is performed until the burr height reaches 50 μm.
Figure 6B:
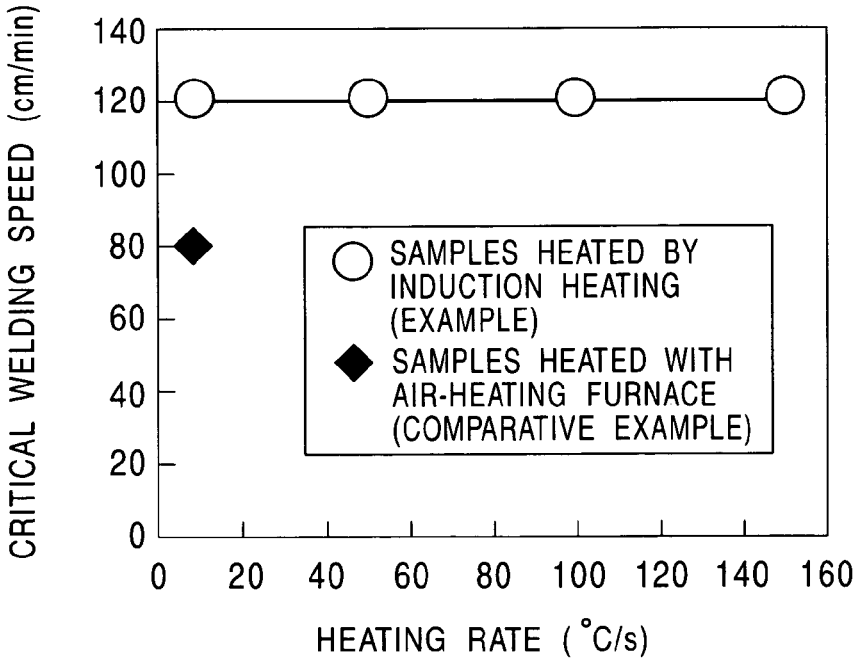
FIG. 6B is a graph showing the relationship between the heating rate of the baking operation of Example 4 and the critical welding speed.

As shown in FIGS. 6A and 6B, the samples of this example that are the electromagnetic steel sheets having the insulating films thereon dried and baked on the side close to the steel sheets (by the induction heating method) are superior in punchability and weldability without depending on the heating rate as compared with the samples of a comparative example.

Example 5

Nonoriented electromagnetic, steel sheets (steel sheets to be treated) having a thickness of 0.35 mm and a surface roughness Ra of 0.4 μm were obtained according to the same procedure as that of Example 1. The steel sheets had the following composition: 0.35 mass % of Si, 0.003 mass % of Al, and 0.1 mass % of Mn, the remainders being Fe and unavoidable impurities.

The electromagnetic steel sheets were cooled to 30° C. Each water-based coating liquid containing solutes and dispersoids (the ratio of water to the total solute and dispersoid amount is 95:5 on a mass basis) was then applied onto surfaces (both faces) of each electromagnetic steel sheet using a roll coater. A combination of the solutes and dispersoids had the following composition: 90 mass % of chromium phosphate and 10 mass % of resins. The resins were an acrylic acid resin (water-soluble) and acrylic emulsion resin (a particle size of 70 nm), and the mixing ratio thereof was varied. The resulting steel sheets were heated by an induction heating method or a heating method using an electric furnace such that the steel sheets were dried and baked at an ultimate temperature of 300° C. Thereby, each insulating film having an area weight of 0.5 g/m$^2$ on a dry basis was formed on each face. Other coating conditions were the same as those of Example 2.

When the electric furnace was used, the temperature was increased to 300° C. during 30 seconds (an average heating rate of 9° C./s). In the induction heating method, the frequency was 30 kHz and the temperature was increased to 300° C. at a heating rate of 100° C./s.

The electromagnetic steel sheets, obtained according to the above procedure, each having the corresponding insulating films thereon were examined for the punchability and weldability. Obtained results are shown in FIGS. 7A and 7B together with the percentage of the emulsion resin in the total resin amount.

Figure 7A:
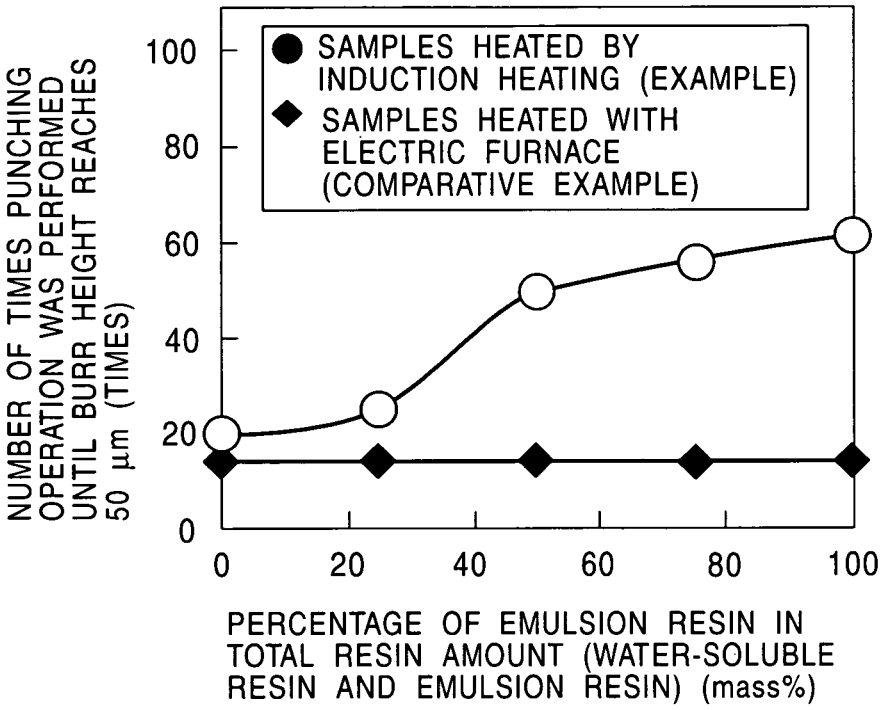
FIG. 7A is a graph showing the relationship between the percentage of an emulsion resin in the total resin amount of Example 5 and the number of times a punching operation is performed until the burr height reaches 50 μm.
Figure 7B:
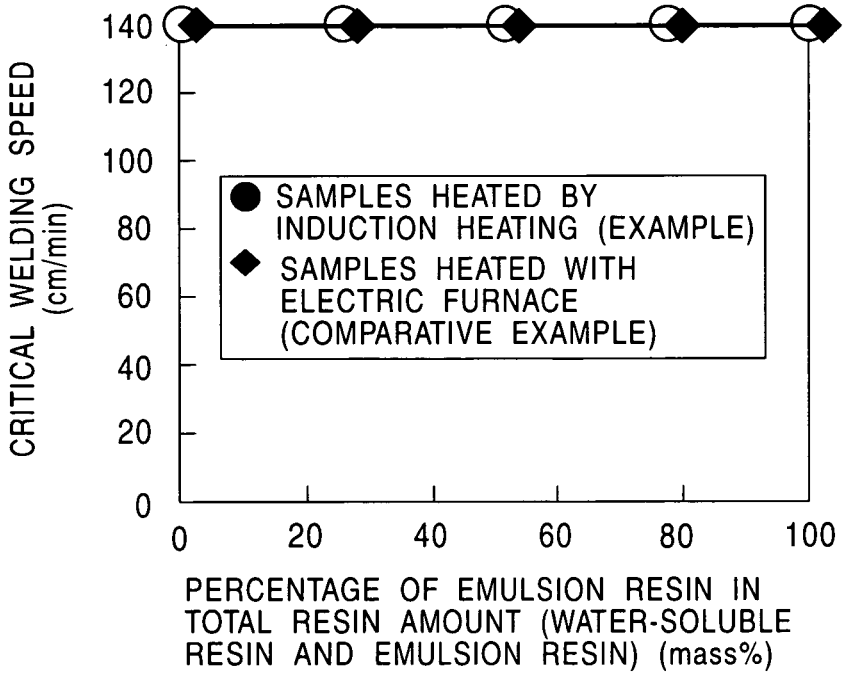
FIG. 7B is a graph showing the relationship between the percentage of the emulsion resin in the total resin amount of Example 5 and the critical welding speed.

As shown in FIGS. 7A and 7B, in the samples of this example that are the electromagnetic steel sheets having the insulating films thereon dried and baked on the side close to the steel sheets (by the induction heating method), the punchability can be effectively enhanced without deteriorating the weldability by increasing the percentage of the emulsion resin in the total resin amount. In particular, the percentage of a particle-forming resin (water insoluble resin) in the total resin amount is about 50 mass % or more, the punchability is remarkably high.

Example 6

Slabs having the following composition were manufactured: 0.35 mass % of Si, 0.001 mass % of Al, and 0.1 mass % of Mn, the remainders being Fe and unavoidable impurities. The slabs were formed into hot-rolled steel sheets having a thickness of 2.8 mm by a hot rolling method, and the hot-rolled steel sheets were processed so as to have a final thickness of 0.5 mm by a single cold rolling method. The resulting steel sheets were finish-annealed at 700° C. for 15 seconds in an atmosphere containing 70% of $N_2$ and 30% of $H_2$ on a volume basis. The resulting steel sheets had a width of 1300 mm and a surface roughness Ra of 0.5 μm.

The obtained electromagnetic steel sheets were cooled to 30° C. Each water-based coating liquid containing solutes and dispersoids (the ratio of water to the total solute and dispersoid amount is 95:5 on a mass basis) was then applied onto surfaces (both faces) of each electromagnetic steel sheet using a roll coater. A combination of the solutes and dispersoids had the following composition: 50 mass % of magnesium dichromate, 20 mass % of an acrylic and styren resin emulsion (a particle size of 100 nr and a glass transition point Tg of 30° C.), 15 mass % of boric acid, and 15 mass % of ethylene glycol. The resulting steel sheets were heated by an induction heating method or a heating method using an air (gas)-heating furnace such that the steel sheets were dried and baked at an ultimate temperature of 300° C. Thereby, each insulating film having an area weight of 0.5 g/m$^2$ on a dry basis was formed on each face. Other coating conditions were the same as those of Example 2.

Some of the steel sheets were temper-rolled at a reduction ratio of 4%.

When the air(gas)-heating furnace was used, the temperature was increased to 300° C. during 30 seconds (an average heating rate of 9° C./s). In the induction heating method, the frequency was 30 kHz, the heating rate was varied by changing the input electricity, and the maximum temperature achieved was 300° C.

The electromagnetic steel sheets, obtained according to the above procedure, each having the corresponding insulating films thereon were examined for the punchability, weldability, and corrosion resistance. Obtained results are shown in FIGS. 8A, 8B, and 8C for comparison.

Figure 9:
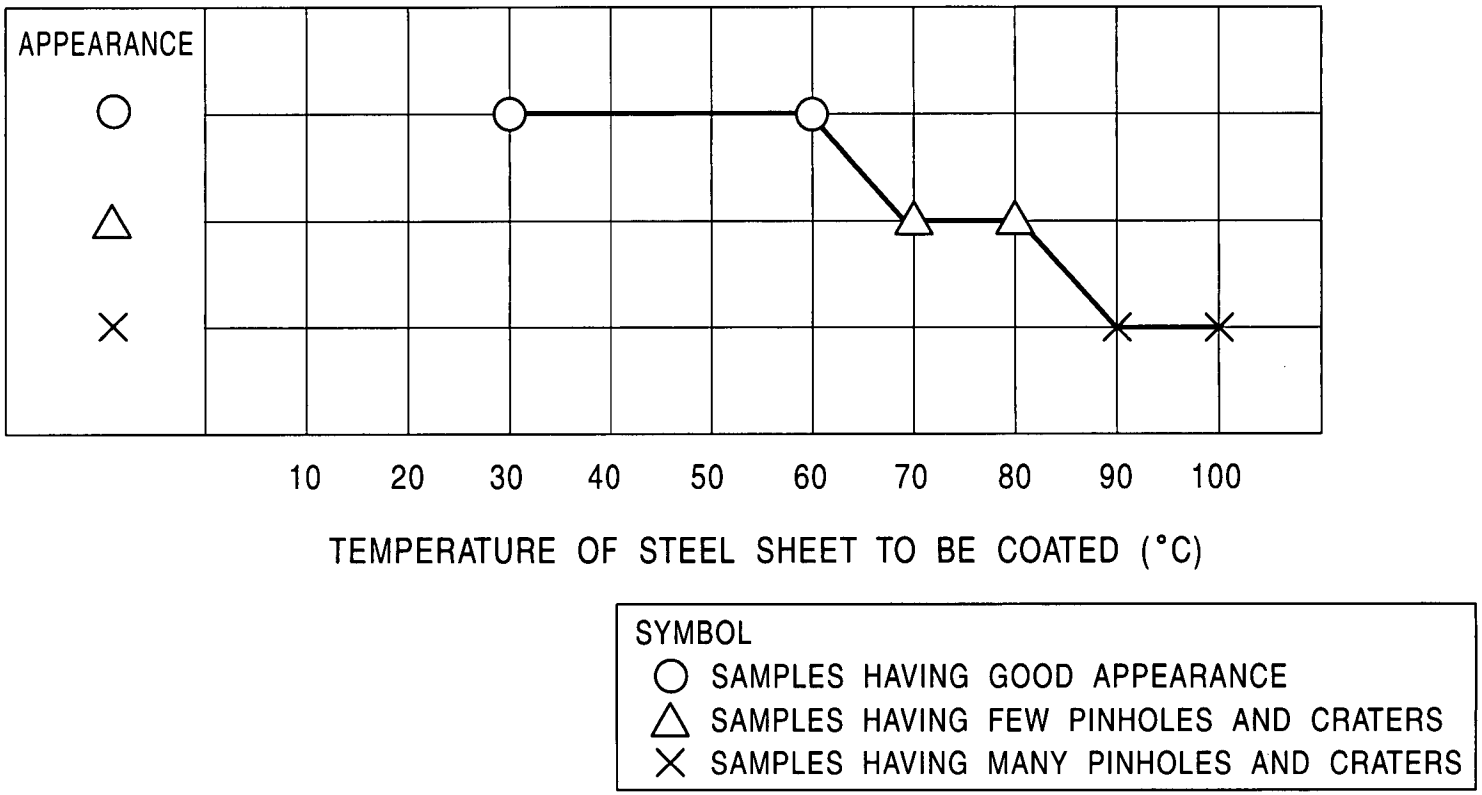
FIG. 9 is a graph showing the relationship between the temperature of steel sheets of Example 6 and the appearance of insulating films, wherein the temperature is measured after finish-annealing but before coating.

The steel sheets were further examined for the appearance in such a manner that the temperature of the finish-annealed steel sheets (that is, the temperature of the uncoated steel sheets) was varied within a range of 30-100° C. Obtained results are shown in FIG. 9. In FIG. 9, the heating rate obtained by the induction heating method is constant, that is, the rate is 100° C./s.

In order to evaluate the corrosion resistance, 100 t or more of the steel sheets were continuously coated without changing or maintaining a roll coater, the resulting steel sheets were dried and baked, and the resulting steel sheets were subjected to a salt spray test (35° C.) specified in JIS Z 2371. The following percentage was used for the evaluation: the percentage of the area of red rust formed after five hours were passed since the test had finished.

Figure 8A:
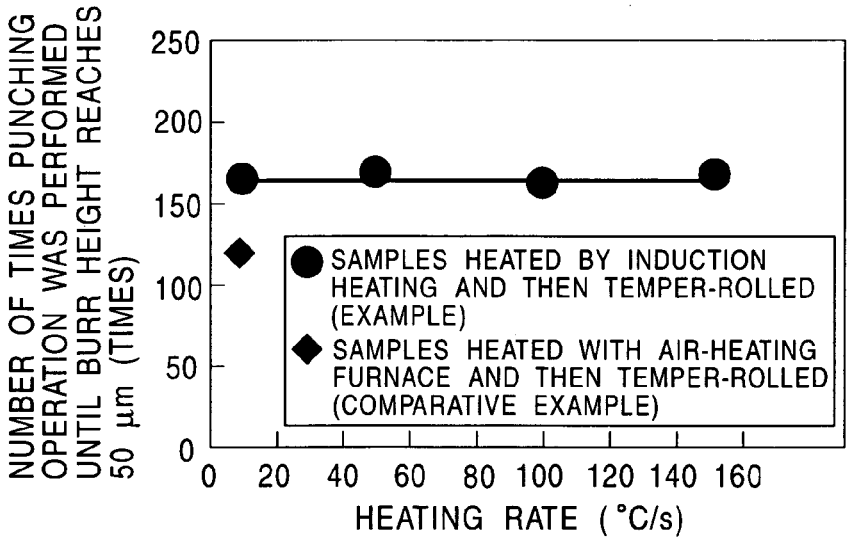
FIG. 8A is a graph showing the relationship between the heating rate of a baking operation of Example 6 and the number of times a punching operation is performed until the burr height reaches 50 μm.
Figure 8B:
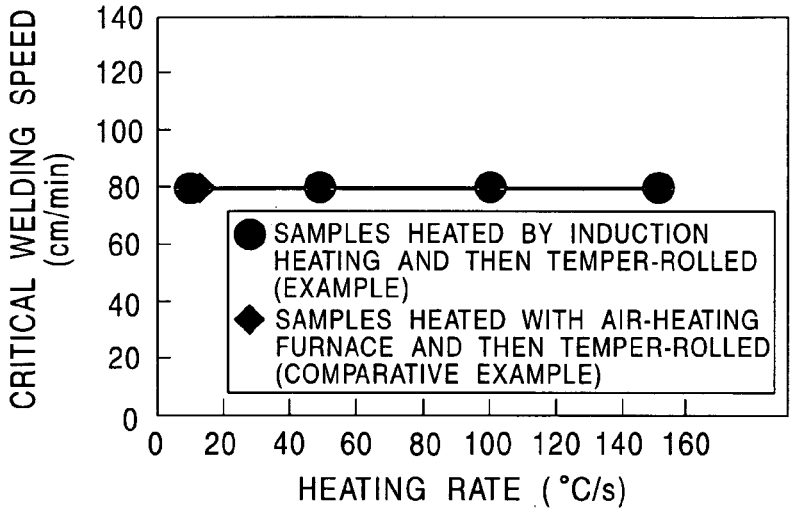
FIG. 8B is a graph showing the relationship between the heating rate of the baking operation of Example 6 and the critical welding speed.
Figure 8C:
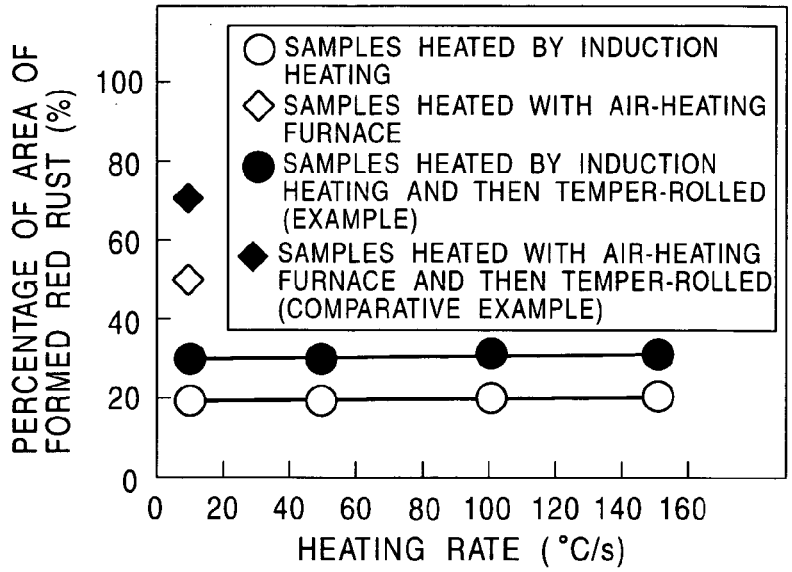
FIG. 8C is a graph showing the relationship between the heating rate of the baking operation of Example 6 and the percentage of an area of formed red rust.

As shown in FIGS. 8A, 8B, and 8C, the samples of this example that are the electromagnetic steel sheets having the insulating films thereon dried and baked on the side close to the steel sheets (by the induction heating method) can be improved in punchability and corrosion resistance without deteriorating the weldability as compared with the samples of a comparative example.

As shown in FIG. 9, the steel sheets onto which the water-based coating liquids were applied at a steel sheet temperature of more than 60° C. after finish annealing have appearance defects such as pinholes. In contrast, the steel sheets which were cooled to 60° C. or less and onto which the water-based coating liquids were then applied have good appearance.

Example 7

Slabs having the following composition were manufactured: 3.0 mass % of Si, 0.3 mass % of Al, and 0.2 mass % of Mn, the remainders being Fe and unavoidable impurities. The slabs were formed into hot-rolled steel sheets having a thickness of 2.2 mm by a hot rolling method, and the hot-rolled steel sheets were processed so as to have a final thickness of 0.35 mm by a single cold rolling method. The steel sheets were then finish-annealed at 900° C. for 10 seconds in an atmosphere containing 70% of $N_2$ and 30% of $H_2$ on a volume basis. The resulting steel sheets had a width of 1200 mm and a surface roughness Ra of 0.3 μm.

The obtained electromagnetic steel sheets were cooled to 60° C. Each water-based coating liquid containing solutes and dispersoids (the ratio of water to the total solute and dispersoid amount is 95:5 on a mass basis) was then applied onto surfaces (both faces) of each electromagnetic steel sheet using a roll coater. A combination of the solutes and dispersoids had the following composition: 60 mass % of colloidal silica containing alumina and 40 mass % of an epoxy resin dispersion (a particle size of 500 nm). The resulting steel sheets were heated by an induction heating method or a heating method using an air(gas)-heating furnace such that the steel sheets were dried and baked at an ultimate temperature of 250° C. Thereby, each insulating film having an area weight of 0.8 g/m$^2$ on a dry basis was formed on each face. Other coating conditions were the same as those of Example 2.

Some of the steel sheets were temper-rolled at a reduction ratio of 8%.

When the air(gas)-heating furnace was used, the temperature was increased to 250° C. during 30 seconds (an average heating rate of 7.7° C./s). In the induction heating method, the frequency was 80 kHz, the heating rate was varied by changing the input electricity, and the maximum temperature achieved was 250° C.

The electromagnetic steel sheets, obtained according to the above procedure, each having the corresponding insulating films thereon were examined for the punchability, weldability, and corrosion resistance. Obtained results are shown in FIGS. 10A, 10B, and 10C for comparison.

Figure 10A:
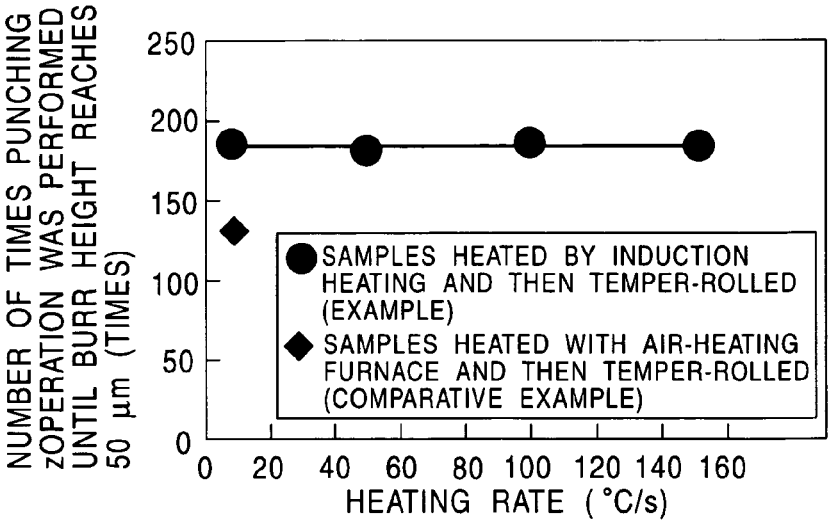
FIG. 10A is a graph showing the relationship between the heating rate of a baking operation of Example 7 and the number of times a punching operation is performed until the burr height reaches 50 μm.
Figure 10B:
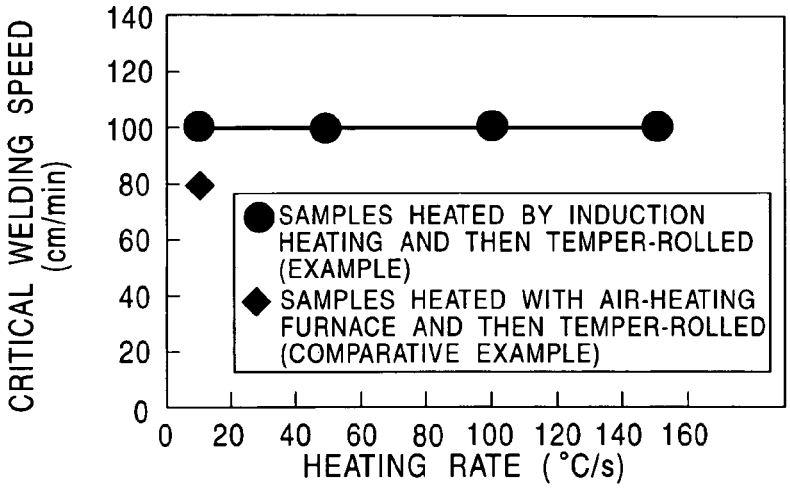
FIG. 10B is a graph showing the relationship between the heating rate of the baking operation of Example 7 and the critical welding speed.
Figure 10C:
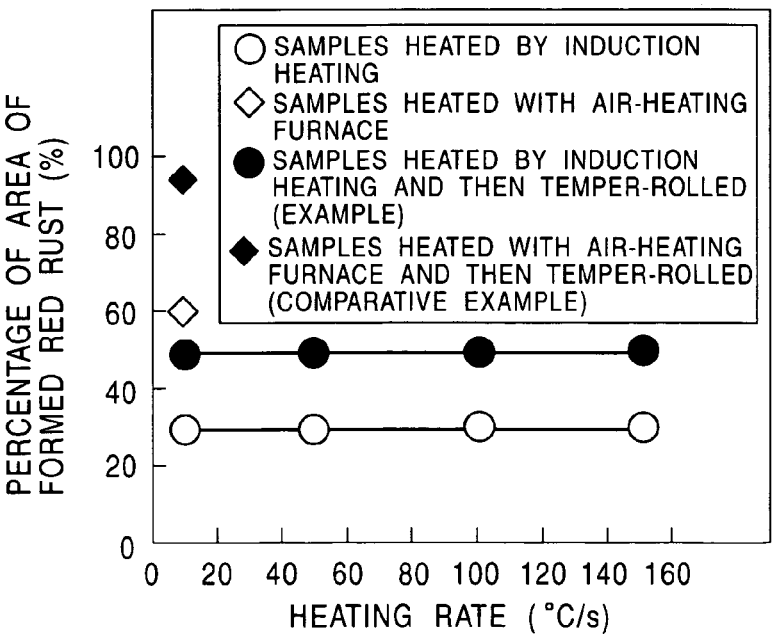
FIG. 10C is a graph showing the relationship between the heating rate of the baking operation of Example 7 and the percentage of an area of formed red rust.

As shown in FIGS. 10A, 10B, and 10C, the samples of this example that are the electromagnetic steel sheets having the insulating films thereon dried and baked on the side close to the steel sheets (by the induction heating method) are superior in punchability and weldability without depending on the heating rate as compared with the samples of a comparative example.

Example 8

Slabs having the following composition were manufactured: 1.2 mass % of Si, 0.2 mass % of Al, and 0.1 mass % of Mn, the remainders being Fe and unavoidable impurities. The slabs were formed into hot-rolled steel sheets having a thickness of 1.6 mm by a hot rolling method, and the hot-rolled steel sheets were processed so as to have a final thickness of 0.35 mm by a single cold rolling method. The steel sheets were then finish-annealed at 800° C. for 10 seconds in an atmosphere containing 70% of $N_2$ and 30% of $H_2$ on a volume basis. The resulting steel sheets had a width of 1300 mm and a surface roughness Ra of 0.4 μm.

The obtained electromagnetic steel sheets were cooled to 30° C. Each water-based coating liquid containing solutes and dispersoids (the ratio of water to the total solute and dispersoid amount is 95:5 on a mass basis) was then applied onto surfaces (both faces) of each electromagnetic steel sheet using a roll coater. A combination of the solutes and dispersoids had the following composition: 50 mass % of aluminum primary phosphate, 15 mass % of potassium dichromate, 30 mass % of an acrylic-vinyl acetate resin emulsion (a particle size of 100 mn and a glass transition point Tg of 20° C.), and 5 mass % of boric acid. The resulting steel sheets were heated by an induction heating method or a heating method using an electric furnace such that the steel sheets were dried and baked at an ultimate temperature of 300° C. Thereby, each insulating film having an area weight of 1.2 g/m$^2$ on a dry basis was formed on each face. Other coating conditions were the same as those of Example 2.

Some of the steel sheets were temper-rolled at a reduction ratio of 8%.

When the electric furnace was used, the temperature was increased to 300° C. during 30 seconds (an average heating rate of 9° C./s). In the induction heating method, the frequency was 30 kHz, the heating rate was varied by changing the input electricity, and the maximum temperature achieved was 300° C.

The electromagnetic steel sheets, obtained according to the above procedure, each having the corresponding insulating films thereon were examined for the punchability, weldability, and corrosion resistance. Obtained results are shown in FIGS. 11A, 11B, and 11C for comparison.

Figure 11A:
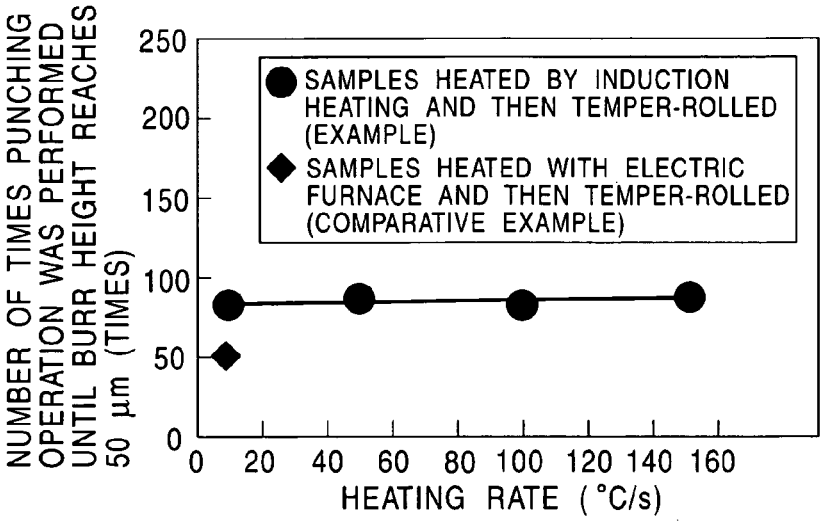
FIG. 11A is a graph showing the relationship between the heating rate of a baking operation of Example 8 and the number of times a punching operation is performed until the burr height reaches 50 μm.
Figure 11B:
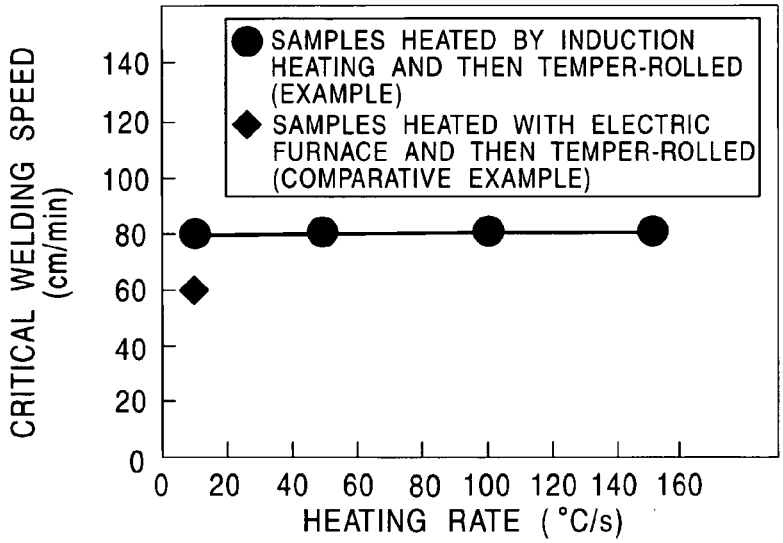
FIG. 11B is a graph showing the relationship between the heating rate of the baking operation of Example 8 and the critical welding speed.
Figure 11C:
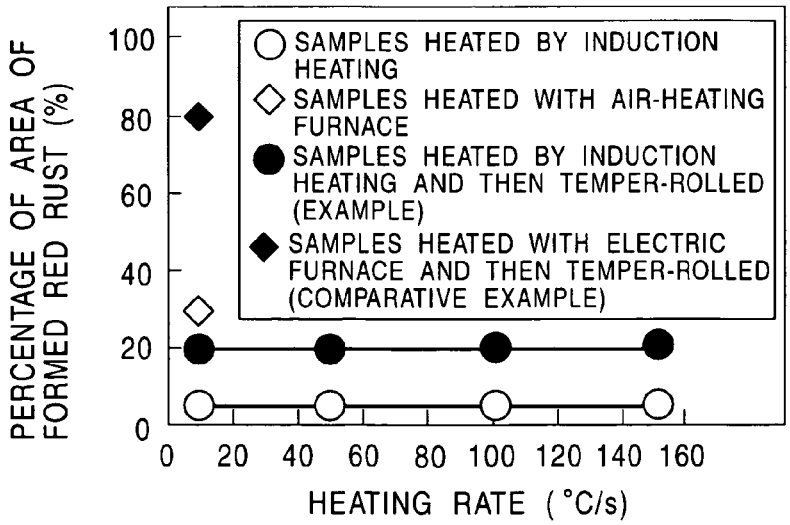
FIG. 11C is a graph showing the relationship between the heating rate of the baking operation of Example 8 and the percentage of an area of formed red rust.

As shown in FIGS. 11A, 11B, and 11C, the samples of this example that are the electromagnetic steel sheets having the insulating films thereon dried and baked on the side close to the steel sheets (by the induction heating method) are superior in punchability and weldability without depending on the heating rate as compared with the samples of a comparative example.

Example 9

Slabs having the following composition were manufactured: 0.1 mass % of Si, 0.001 mass % of Al, and 0.1 mass % of Mn, the remainders being Fe and unavoidable impurities.

The slabs were formed into hot-rolled steel sheets having a thickness of 2.8 mm by a hot rolling method, and the hot-rolled steel sheets were processed so as to have a final thickness of 0.70 mm by a single cold rolling method. The steel sheets were then finish-annealed at 700° C. for 15 seconds in an atmosphere containing 70% of $N_2$ and 30% of $H_2$ on a volume basis. The resulting steel sheets had a width of 1000 mm and a surface roughness Ra of 0.4 μm.

The obtained electromagnetic steel sheets were cooled to 30° C. Each water-based coating liquid containing solutes and dispersoids (the ratio of water to the total solute and dispersoid amount is 95:5 on a mass basis) was then applied onto surfaces of each electromagnetic steel sheet using a roll coater. A combination of the solutes and dispersoids had the following composition: 50 mass % of aluminum dichromate, 15 mass % of a polyethylene resin emulsion, 20 mass % of aluminum primary phosphate, and 15 mass % of ethylene glycol. The resulting steel sheets were heated by an induction heating method or a heating method using an air(gas)-heating furnace such that the steel sheets were dried and baked at an ultimate temperature of 200° C. Thereby, each insulating film having an area weight of 1.5 g/m$^2$ on a dry basis was formed on each face. Other coating conditions were the same as those of Example 2.

Some of the steel sheets were temper-rolled at a reduction ratio of 3%.

When the air(gas)-heating furnace was used, the temperature was increased to 200° C. during 30 seconds (an average heating rate of 6° C./s). In the induction heating method, the frequency was 10 kHz, the heating rate was varied by changing the input electricity, and the maximum temperature achieved was 200° C.

The electromagnetic steel sheets, obtained according to the above procedure, each having the corresponding insulating films thereon were examined for the punchability, weldability, and corrosion resistance. Obtained results are shown in FIGS. 12A, 12B, and 12C for comparison.

Figure 12A:
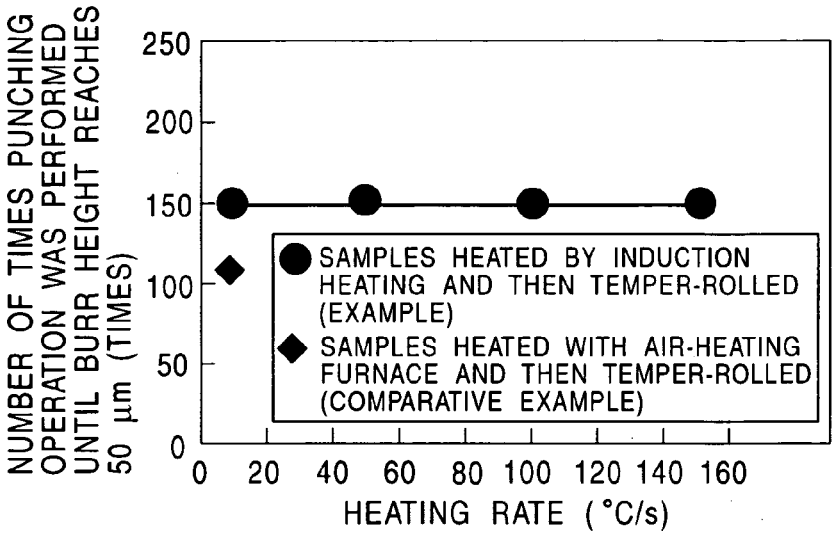
FIG. 12A is a graph showing the relationship between the heating rate of a baking operation of Example 9 and the number of times a punching operation is performed until the burr height reaches 50 μm.
Figure 12B:
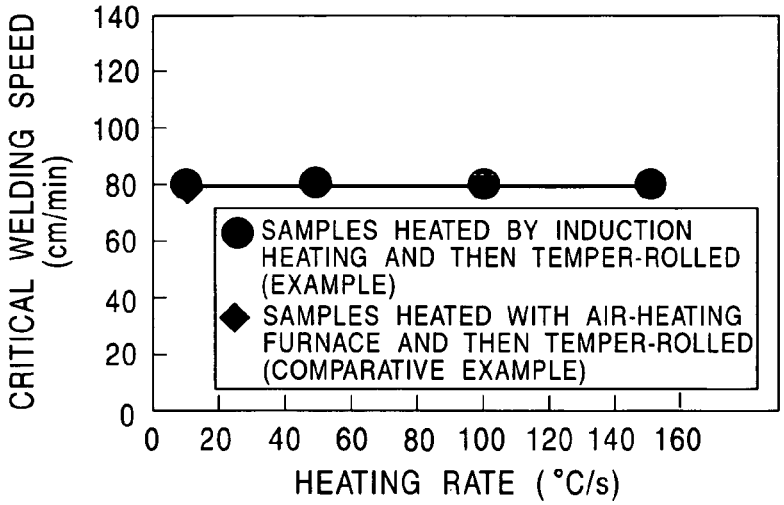
FIG. 12B is a graph showing the relationship between the heating rate of the baking operation of Example 9 and the critical welding speed.
Figure 12C:
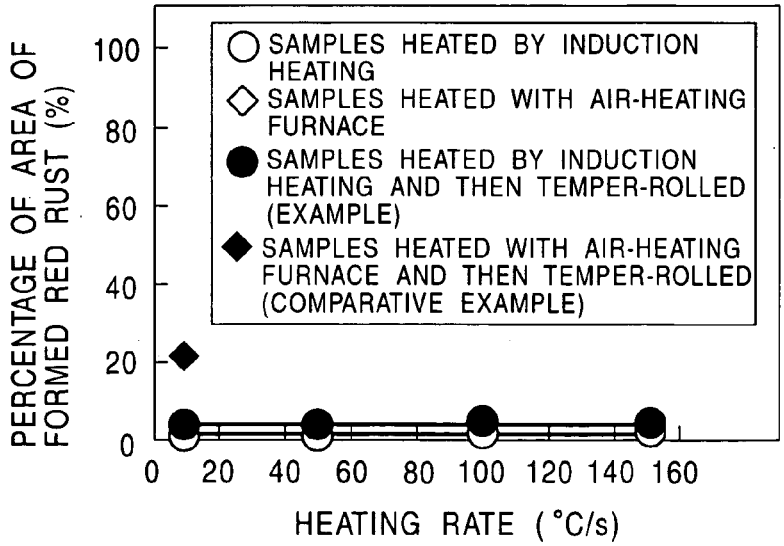
FIG. 12C is a graph showing the relationship between the heating rate of the baking operation of Example 9 and the percentage of an area of formed red rust.

As shown in FIGS. 12A, 12B, and 12C, the samples of this example that are the electromagnetic steel sheets having the insulating films thereon dried and baked on the side close to the steel sheets (by the induction heating method) can be improved in punchability and corrosion resistance without deteriorating the weldability as compared with the samples of a comparative example.

Example 10

Slabs having the following composition were manufactured: 0.35 mass % of Si, 0.003 mass % of Al, and 0.1 mass % of Mn, the remainders being Fe and unavoidable impurities. The slabs were formed into hot-rolled steel sheets having a thickness of 2.6 mm by a hot rolling method, and the hot-rolled steel sheets were processed so as to have a final thickness of 0.50 mm by a single cold rolling method. The steel sheets were then finish-annealed at 750° C. for 30 seconds in an atmosphere containing 70% of $N_2$ and 30% of $H_2$ on a volume basis. The resulting steel sheets had a width of 1200 mm and a surface roughness Ra of 0.4 μm.

The obtained electromagnetic steel sheets were cooled to 30° C. Each water-based coating liquid having a total solute and dispersoid content of 3% was then applied onto surfaces of each electromagnetic steel sheet using a roll coater. A combination of the solutes and dispersoids had the following composition: 90 mass % of chromium phosphate and 10 mass % of resins. The resins were an acrylic acid resin (water-soluble) and an acrylic emulsion resin (a particle size of 100 nm), and the ratio of the acrylic acid resin to the acrylic emulsion resin was varied. The resulting steel sheets were heated by an induction heating method or a heating method using an electric furnace such that the steel sheets were dried and baked at an ultimate temperature of 300° C. Thereby, each insulating film having an area weight of 1.0 g/m$^2$ on a dry basis was formed on each face. Other coating conditions were the same as those of Example 2.

Some of the steel sheets were temper-rolled at a reduction ratio of 2%.

When the electric furnace was used, the temperature was increased to 300° C. during 30 seconds (an average heating rate of 9° C./s). In the induction heating method, the frequency was 30 kHz and the temperature was increased to 300° C. at a heating rate of 100° C./s.

The electromagnetic steel sheets, obtained according to the above procedure, each having the corresponding insulating films thereon were examined for the punchability, weldability, and corrosion resistance. Obtained results are shown in FIGS. 13A, 13B, and 13C together with the percentage of the emulsion resin in the total resin amount for comparison.

Figure 13A:
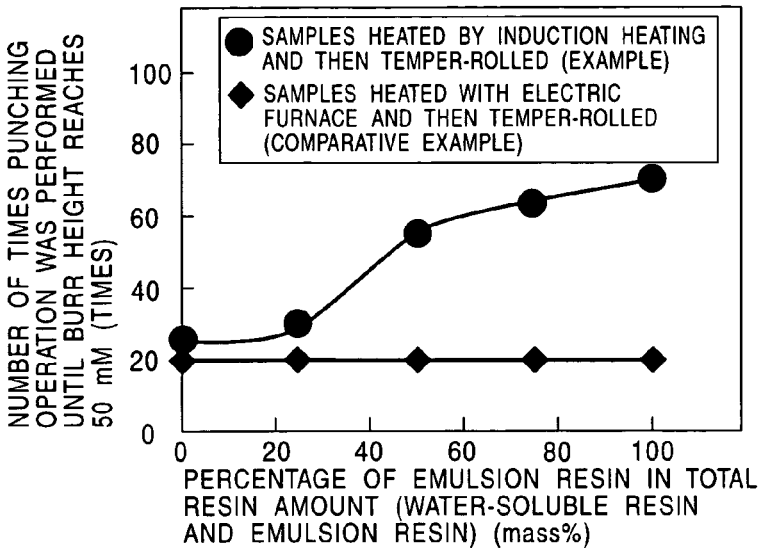
FIG. 13A is a graph showing the relationship between the percentage of an emulsion resin in the total resin amount of Example 10 and the number of times a punching operation is performed until the burr height reaches 50 μm.
Figure 13B:
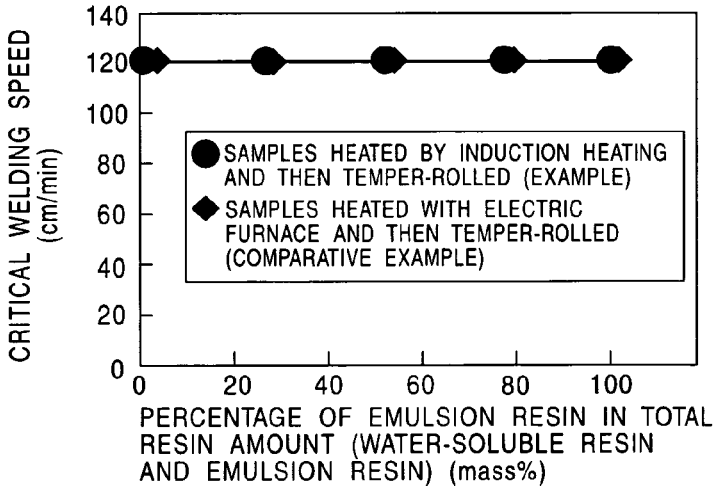
FIG. 13B is a graph showing the relationship between the percentage of the emulsion resin in the total resin amount of Example 10 and the critical welding speed.
Figure 13C:
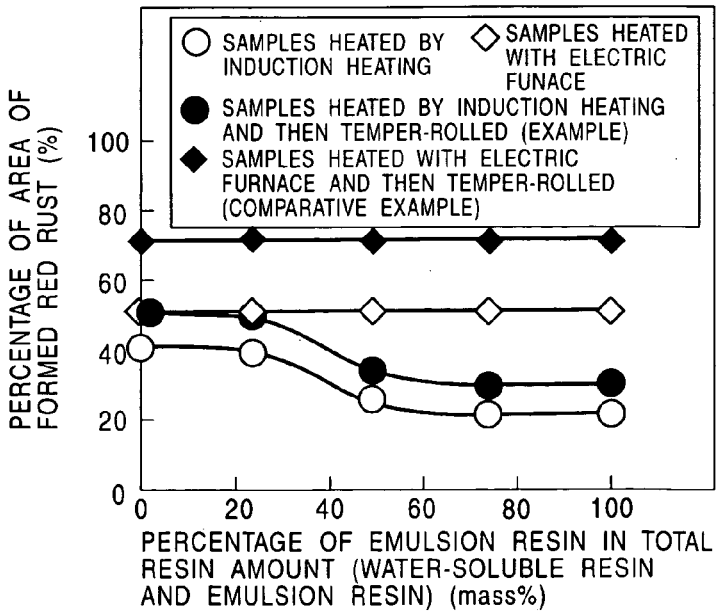
FIG. 13C is a graph showing the relationship between the percentage of the emulsion resin in the total resin amount of Example 10 and the percentage of an area of formed red rust.

As shown in FIGS. 13A, 13B, and 13C, in the samples of this example that are the electromagnetic steel sheets having the insulating films thereon dried and baked on the side close to the steel sheets (by the induction heating method), the punchability and the corrosion resistance can be effectively enhanced without deteriorating the weldability by increasing the percentage of the emulsion resin in the total resin amount. In particular, the percentage of a particle-forming resin in the total resin amount is about 50 mass % or more, the punchability is remarkably high.

Example 11

Slabs having the following composition were manufactured: 0.2 mass % of Si, 0.2 mass % of Al, and 0.2 mass % of Mn, the remainders being Fe and unavoidable impurities. The slabs were formed into hot-rolled steel sheets having a thickness of 2.2 mm by a hot rolling method, and the hot-rolled steel sheets were processed so as to have a final thickness of 0.50 mm by a single cold rolling method. The steel sheets were then finish-annealed at 800° C. for 10 seconds in an atmosphere containing 70% of $N_2$ and 30% of $H_2$ on a volume basis. The resulting steel sheets had a width of 1000 mm and a surface roughness Ra of 0.3 μm.

The electromagnetic steel sheets were cooled to 30° C. Each water-based coating liquid containing solutes and dispersoids (the ratio of water to the total solute and dispersoid amount is 95:5 on a mass basis) was then applied onto surfaces of each electromagnetic steel sheet using a roll coater. A combination of the solutes and dispersoids had the following composition: 60 mass % of colloidal silica containing alumina and 40 mass % of an epoxy resin dispersion. The resulting steel sheets were heated by an induction heating method or a heating method using an air(gas)-heating furnace such that the steel sheets were dried and baked at an ultimate temperature of 250° C. Thereby, each insulating film having an area weight of 0.8 g/m$^2$ on a dry basis was formed on each face. Other coating conditions were the same as those of Example 2.

The steel sheets were then temper-rolled at various reduction ratios.

When the air(gas)-heating furnace was used, the temperature was increased to 250° C. during 30 seconds (an average heating rate of 7.7° C./s). In the induction heating method, the frequency was 80 kHz, the heating rate was varied by changing the input electricity, and the maximum temperature achieved was 250° C.

The electromagnetic steel sheets, obtained according to the above procedure, each having the corresponding insulating films thereon were examined for the punchability, weldability, and corrosion resistance. Obtained results are shown in FIGS. 14A, 14B, and 14C for comparison.

Some of the steel sheets were subjected to stress relief annealing at 750° C. for two hours in a nitrogen atmosphere, and the resulting steel sheets were examined for the iron loss. Obtained results are shown in FIG. 15.

Figure 14A:
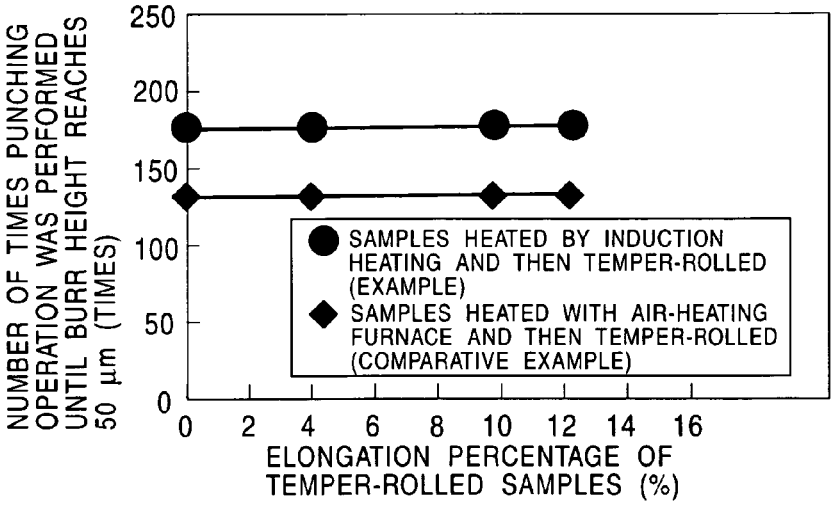
FIG. 14A is a graph showing the relationship between the elongation percentage of temper-rolled steel sheets of Example 11 and the number of times a punching operation is performed until the burr height reaches 50 μm.
Figure 14B:
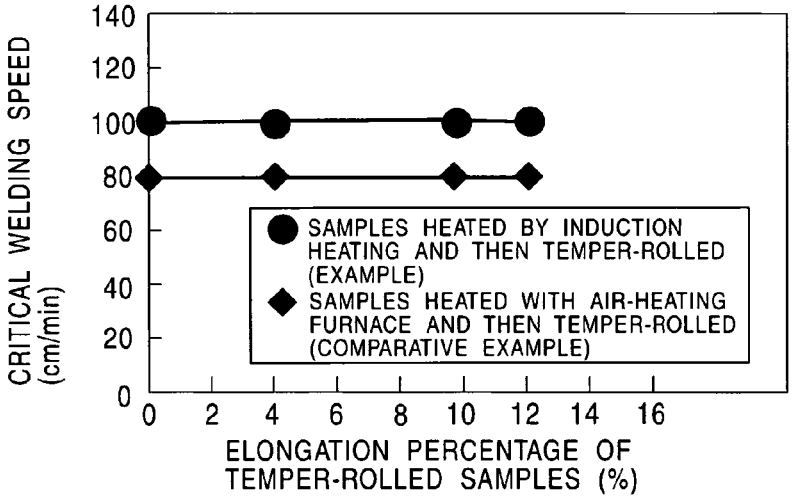
FIG. 14B is a graph showing the relationship between the elongation percentage of the temper-rolled steel sheets of Example 11 and the critical welding speed.
Figure 14C:
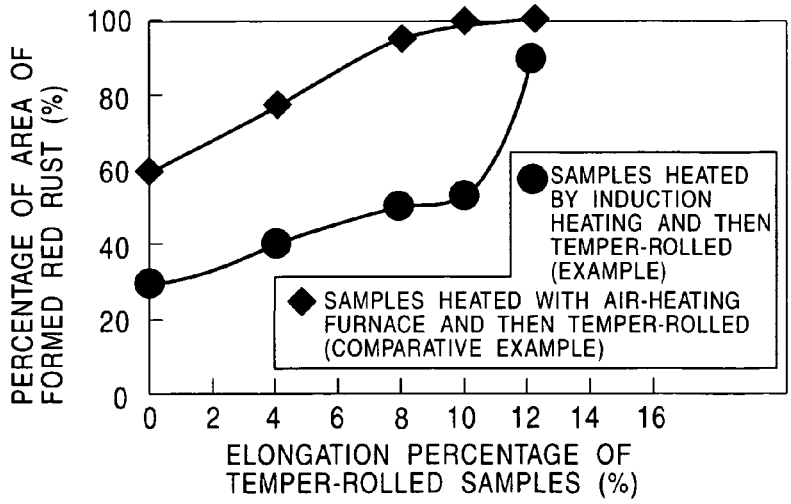
FIG. 14C is a graph showing the relationship between the elongation percentage of the temper-rolled steel sheets of Example 11 and the percentage of an area of red rust.

As shown in FIGS. 14A, 14B, and 14C, in the samples of this example that are the electromagnetic steel sheets having the insulating films thereon dried and baked on the side close to the steel sheets (by the induction heating method), the punchability, weldability, and corrosion resistance are more satisfactory than those of the samples of a comparative example without depending on the heating rate, even though the electromagnetic steel sheets have been temper-rolled at a reduction ratio of about 10% or less.

Figure 15:
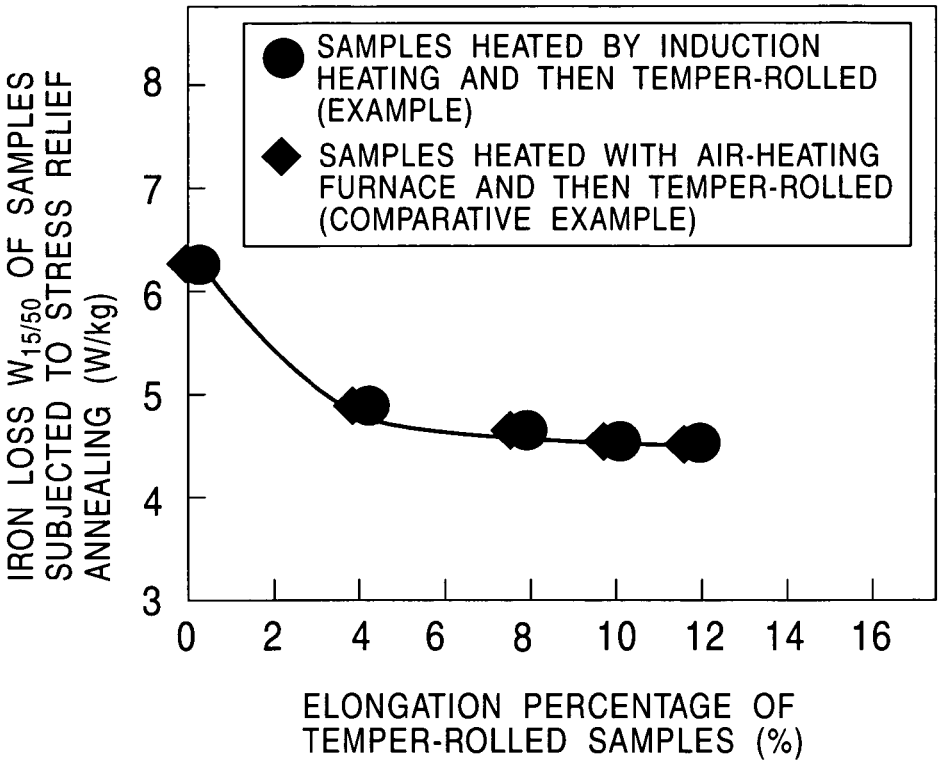
FIG. 15 is a graph showing the relationship between the elongation percentage of the temper-rolled steel sheets of Example 11 and the iron loss of the steel sheets subjected to stress relief annealing.

FIG. 15 shows that the iron loss of the samples of this example is not deteriorated as compared with that of the samples of a comparative example.

INDUSTRIAL APPLICABILITY

A coated steel sheet having satisfactory appearance and having no coating unevenness and flash rust thereon can be manufactured in such a manner that a water-based coating liquid containing an organic resin is applied onto a steel sheet using a coating line directly connected to a final annealing furnace and the resulting steel sheet is then dried and baked.

Paint can be prevented from being adhered to a roll coater when a coating operation is continued for a long time, thereby greatly reducing the number of times the roll coater is cleaned.

When the our process is applied to electromagnetic steel sheets each having an insulating film thereon, an electromagnetic steel sheet having satisfactory weldability and punchability can be readily manufactured in a reproducible manner without deteriorating, for example, the space factor by one coating operation and one baking operation (an one-coat, one-bake system). In this process, a large variety of resins, for example can be used. Such an electromagnetic steel sheet is useful in motor and transformer applications.

The electromagnetic steel sheet covered with the insulating film can be temper-rolled without deteriorating film properties and the resulting steel sheet is very useful.

The invention claimed is:

1. A process for manufacturing a coated steel sheet, comprising:

a coating step of applying a water-based coating liquid containing a resin and a passivator onto an annealed steel sheet comprising an electromagnetic steel sheet at a line speed of 150 m/min or more;

a drying step of drying the applied coating liquid to form a substantially even coating layer in such a manner that the applied liquid is heated on the side close to the steel sheet;

a preventing step of preventing coating fine unevenness as a surface property of the coating caused by vibration, impact and paint dripping while the steel sheet is conveyed on a transfer line from the coating step to the drying step at said line speed, by controlling time elapsed between the application of the coating liquid and substantial completion of drying, the substantial completion of drying being defined as the temperature of the steel sheet reaching 100° C., to 10 seconds or less; and a baking step of heating the dry coating layer to a predetermined temperature to bake the coating layer to form a coating film, wherein the steps are conducted with a vertical arrangement of a coating and a heating apparatus.

2. The process according to claim 1, wherein the time elapsed between application of the coating liquid and the substantial completion of drying is 8 seconds or less.

3. The process according to claim 2, wherein the time elapsed between application of the coating liquid and substantial completion of drying includes a time of 2 to 5 seconds elapsed until the steel sheet is placed in a furnace after the application.

4. The process according to claim 1, wherein the time elapsed between application of the coating liquid and the substantial completion of drying is 6 seconds or less.

5. The process according to any one of claims 1 to 4, wherein the water-based coating liquid further contains an inorganic component, and the coating film is an insulating film.

6. The process according to claim 5 further comprising an untreated steel sheet-manufacturing step of subjecting a steel ingot for manufacturing the nonoriented electromagnetic steel sheet to rolling and annealing at an ultimate sheet temperature of 600 to 1100° C. once or a plurality of times to manufacture a steel sheet having a thickness of 0. 1 to 0.9 mm and then cooling the steel sheet to 60° C. or less to manufacture the nonoriented electromagnetic steel sheet, wherein the untreated steel sheet-manufacturing step is performed before the coating step.

7. The process according to claim 5 further comprising an untreated steel sheet-manufacturing step of subjecting a steel ingot for manufacturing the nonoriented electromagnetic steel sheet to rolling and annealing at an ultimate sheet temperature of 600 to 1000° C. once or a plurality of times to form a steel sheet having a thickness of 0.1 to 0.9 mm and then cooling the steel sheet to 60° C. or less to manufacture the nonoriented electromagnetic steel sheet and further comprising a temper-rolling step of temper-rolling the steel sheet at a reduction ratio of 10% or less to manufacture a nonoriented electromagnetic steel sheet delivered in the semi-processed state, wherein the untreated steel sheet-manufacturing step is performed before the coating step and the temper-rolling step is performed after the baking step.

8. The process according to claim 1, wherein the drying step uses an induction heating method to heat the applied liquid on the side close to the steel sheet.

9. The process according to claim 1, wherein the dry coating layer is heated on the side close to the steel sheet to a predetermined temperature in the baking step.

10. The process according to claim 9, wherein the baking step uses an induction heating method to heat the coating layer on the side close to the steel sheet.

11. The process according to claim 9, wherein the drying step and baking step use an induction heating method to heat the applied liquid and then the coating layer on the side close to the steel sheet.

12. The process according to claim 1, further comprising a washing step of washing the annealed steel sheet with water is performed before the coating step.

13. The process according to claim 1, wherein the water-based coating liquid containing the resin is applied onto the steel sheet using a roll coater and the temperature of the uncoated steel sheet is 60° C. or less and lower than or equal to a temperature 20° C. higher than the glass transition point (Tg) of the resin contained in the water-based coating liquid.

14. The process according to claim 1, wherein the percentage of one of an emulsion resin, dispersion resin, suspension resin, and powder resin having a particle size of 30 nm or more in the total resin amount is 50 mass % or more.

15. The process according to claim 1, wherein the coating film is formed on each face of the annealed steel sheet.

16. The process according to claim 15, wherein the coating liquid is simultaneously applied onto both faces of the annealed steel sheet in the coating step.

17. The process according to claim 1, wherein the time between application of the coating liquid and substantial completion of drying is 6 seconds or less, thereby achieving coating evenness the same as that of horizontally-arranged coating and heating apparatus, even using the vertically-arranged coating and heating apparatus.

18. The process according to claim 1, wherein the time elapsed between application of the coating liquid and substantial completion of drying includes a time of 2 to 8 seconds elapsed until the steel sheet is placed in a furnace after the application.

19. The process according to claim 1, wherein the passivator is a chromium compound.

20. The process according to claim 1, wherein heating the side close to the steel sheet concentrates resin particles dispersed in the coating at surface portions of the coating.

21. A process for manufacturing a coated steel sheet, comprising:

a coating step of applying a water-based coating liquid containing a resin and a passivator with at least one of a roll coater method, bar coater method, air-knife method or spray coater method onto an annealed steel sheet comprising an electromagnetic steel sheet at a line speed of 150 m/min or more;

a drying step of drying the applied coating liquid to form a substantially even coating layer in such a manner that the applied liquid is heated on the side close to the steel sheet;

a preventing step of preventing coating fine unevenness caused by vibration, impact and paint dripping while the steel sheet is conveyed on a transfer line from the coating step to the drying step at said line speed, by controlling time elapsed between the application of the coating liquid and substantial completion of drying, the substantial completion of drying being defined as the temperature of the steel sheet reaching 100° C., to 10 seconds or less; and a baking step of heating the dry coating layer to a predetermined temperature to bake the coating layer to form a coating film, wherein the steps are conducted with a vertical arrangement of a coating and a heating apparatus.

* * * * *